US005704197A

United States Patent [19]

Gifford

[11] Patent Number: 5,704,197

[45] Date of Patent: Jan. 6, 1998

[54] BAG FILLING AND CLOSING MACHINE

[75] Inventor: Jon W. Gifford, Brooklyn Park, Minn.

[73] Assignee: Bemic Company, Inc., Minneapolis, Minn.

[21] Appl. No.: 610,372

[22] Filed: Mar. 4, 1996

[51] Int. Cl.[6] ..... B65B 1/06; B65B 1/22; B65B 43/30; B65B 43/34

[52] U.S. Cl. ..... 53/571; 53/284.7; 53/525; 53/249; 53/260; 141/114

[58] Field of Search ..... 53/570, 571, 572, 53/573, 284.7, 525, 505, 67, 69, 249, 260, 386.1; 141/10, 114

[56] References Cited

U.S. PATENT DOCUMENTS

| | | | |
|---|---|---|---|
| 2,689,073 | 9/1954 | Twigg | 53/505 X |
| 3,050,918 | 8/1962 | Helm et al. | 53/386 |
| 3,096,081 | 7/1963 | Helm et al. . | |
| 3,488,915 | 1/1970 | Delestatius | 53/525 X |
| 3,501,893 | 3/1970 | Peterson | 53/573 |
| 3,566,578 | 3/1971 | Thorne et al. | 53/573 X |
| 3,676,977 | 7/1972 | Rothmann et al. | 53/525 X |
| 3,750,721 | 8/1973 | Hudson | 53/570 X |
| 3,948,015 | 4/1976 | Lerner | 53/570 X |
| 4,561,238 | 12/1985 | Odom | 53/284.7 X |
| 5,052,169 | 10/1991 | Gronlie et al. | 53/284.7 X |
| 5,115,619 | 5/1992 | Lieder | 53/284.7 X |
| 5,452,567 | 9/1995 | Lieder | 53/571 X |
| 5,463,845 | 11/1995 | Gwiazdon et al. | 53/284.7 X |
| 5,507,132 | 4/1996 | Gwiazdon et al. | 53/284.7 X |

*Primary Examiner*—Horace M. Culver
*Attorney, Agent, or Firm*—Clayton R. Johnson

[57] ABSTRACT

Bag pick up and feed assembles pick up a flat folded bag from a magazine and direct the picked up bag to a bag positioner assembly, the feed assembly including a first set of rollers moved away from a second set before the bag is moved therebetween and thence together to feed the bag. The positioner assembly moves the bag to extend vertically for top edge portions being clampingly engaged by a carriage assembly and thereby forwardly conveyed to beneath a hopper spout. Bag top side wall portions of the clamped bags are spread by vacuum cups of the carriage assembly. Power operated linkage mechanism moves closed spout jaws downwardly between the spread side wall portions and thence open the jaws to spread the bag side walls as product is discharged through opening jaws to open the clamped bag. The carriage assembly includes clamp plates mounting bag top clamps, vacuum cup mounting members and mechanical linkage interconnecting the clamp plates and vacuum cup mounting members to move the clamp plates toward one another as the opening spout jaws force the cup mounting plates apart. A shaker subassembly mounts a saddle subassembly for vertical movement while the saddle subassembly includes a bag bottom support member that is reciprocate for shaking a bag during filling.

28 Claims, 21 Drawing Sheets

| SECONDS → | 0.1 0.2 0.3 0.4 0.5 0.6 0.7 0.8 0.9 1.0 1.1 1.2 1.3 1.4 1.5 1.6 1.7 1.8 1.9 2.0 2.1 2.2 2.3 2.4 2.5 2.6 2.7 2.8 2.9 3 | | | | | | | |
|---|---|---|---|---|---|---|---|---|
| CARRIAGE DRIVE | CARRIAGE STARTS | BAG CLAMPED | CARRIAGE STOPS | | | | | |
| BAG FEED CYCLE | PICK-UP EXTENDS DOWN | PICK-UP RETRACTS UP | BAG FEED IN | FEED OUT | BAG FEEDS IN | PICK-UP EXTENDS DOWN | | |
| BAG POSITIONER | BAG POSITIONER CLOSED | BAG POSITIONER OPENS | BAG POSITIONER CLOSES | | | | | |
| BAG OPENING CYCLE | VACUUM OFF | VACUUM ON CUPS IN | CUPS OUT | VACUUM OFF | | | | |
| SPOUT UP AND DOWN | SPOUT UP | DOWN TRAVEL | SPOUTS DOWN & OPEN | SPOUT UP TRAVEL | SPOUT UP | | | |
| SHAKER CYCLE | SADDLE UP SHAKER DOWN | SADDLE DOWN BEFORE SHAKE | SADDLE UP SHAKING | SADDLE UP SHAKER DOWN | | | | |
| TRANSFER CYCLE | TRANSFER GRIPPERS CLOSED AND TRAVELING OUT | GRIPPERS OUT RETURN DELAY | GRIPPERS OUT TRAVELING BACK | START CLOSED | CLOSED | | | |
| SCALE DUMP CYCLE | BYPASS DUMP REQUEST | PRECHARGE DUMP REQUEST | | | | | | |

NOTES: 1) A (1) SECOND DUMP TIME EQUATES TO 18 BPM. (DUMP TIME=SADDLE DOWN BEFORE SHAKE PLUS SADDLE UP AND DOWN I.E. SHAKER DURATION)

2) BYPASS MODE—THE SCALE DUMPS STRAIGHT THROUGH TO THE BAG.
PRECHARGE MODE—SCALE DUMPS WHEN SPOUT RETRACTS ALLOWING CHARGE TO SETTLE IN SPOUT AND HOPPER PRIOR TO DISCHARGE INTO THE BAG.

3) PRODUCTS TOO LIGHT OR TOO DUSTY FOR PRECHARGE SHOULD BE SOLD FOR 18 BPM MAX.

4) THE BAG POSITIONER MUST BE CLOSED BEFORE THE CARRIAGE CAN START BACK.

FIG. 27

BAG FILLING AND CLOSING MACHINE

BACKGROUND OF THE INVENTION

A machine for automatically opening and filling a bag and transferring the filled bag to a discharge station.

In U.S. Pat. No. 4,561,238 to Odom there is disclosed a machine for picking up, opening, filling and closing a filled bag, said machine including a positioner assembly for receiving a flat folded bag and supporting the bag in a position to be gripped by a spout carriage assembly. The carriage assembly opens the bag and moves the bag horizontally to a filling station where the bag is filled. U.S. Pat. No. 3,050,918 to Helm discloses a machine for removing a flat folded bag from a magazine, opening the bag and positioning the opened bag on a spout assembly to be carried thereby to a filling station bag release position.

In order to make improvements in machines for opening and filling bags, particularly improvements in carrying out the timing of various movements of the components of the machine, this invention has been made.

SUMMARY OF THE INVENTION

The bag filling and closing machine includes a feed assembly for picking up a flat folded bag from a bag magazine and feeding the bag to a bag positioner assembly that moves the bag to a vertical position and a carriage assembly for clampingly engaging the vertical bag in the positioner assembly and moving the clamped bag to a filling station beneath a hopper spout assembly where the bag is opened and filled and a saddle and shaker assembly for settling product in the bag. A transfer assembly grips the filled bag on the saddle and shaker assembly and transfers the bag to a conveyor at the discharge station.

One of the objects of the invention is to provide new and novel means for feeding a picked up bag to a positioner assembly in proper orientation to the positioner assembly. Another object of this invention is to provide new and novel means for moving a flat folded bag from a positioner assembly to a position beneath a hopper spout assembly. A still further object of this invention is to provide new and novel means for clampingly engaging an unopened bag, at least opening the upper edge portions of the clamped bag while transferring the clamped bag to a filling station and thence closing the filled bag. In furtherance of the last mentioned object, it is another object of this invention to provide new and novel mechanical linkage mechanism for carrying a number of the operations in opening and closing the filled bag. Still another object of this invention is to provide new and novel means for moving a spout subassembly from a raised closed position to a position extending into partially opened bag top edge portions and thence further opening the bag top as product is discharged into the bag to complete the opening of the bag. A further object of this invention is to provide new and novel means for shaking a bag with product therein to settle the product as the bag is being filled.

BRIEF DESCRIPTION OF THE DRAWINGS

FIG. 27 is a sequence chart showing the sequence of operation of various assemblies and components.

Figure 1A:
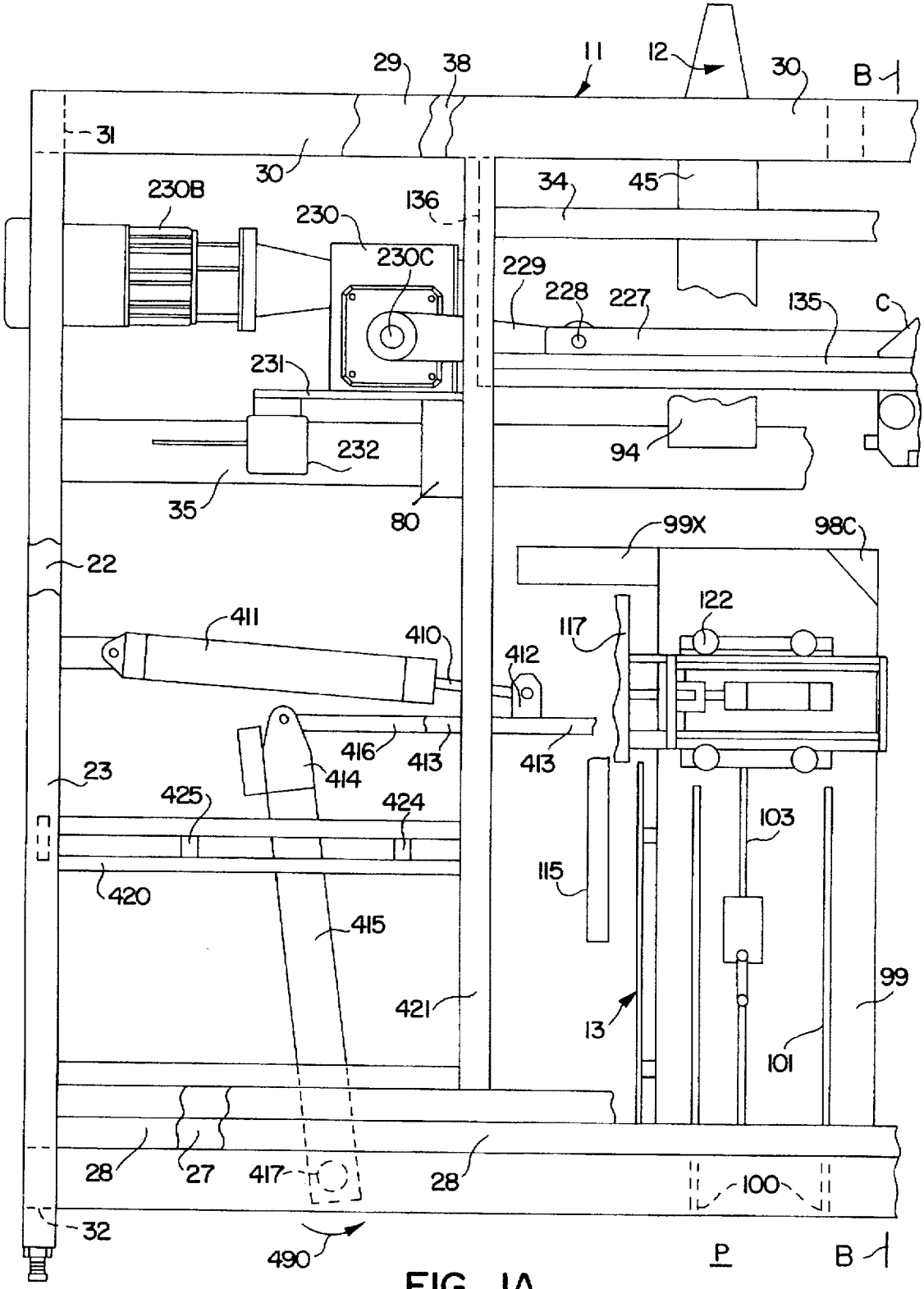
FIGS. 1A and 1B when arranged with lines B—B aligned is a somewhat diagrammatic side view of the apparatus of this invention with the carriage assembly and the transfer assembly being beneath the spout subassembly and many parts not being shown.

Referring in particular to FIGS. 1A, 1B and 2–5, the apparatus of this invention includes a main frame 11, a bag pick up assembly 12 on the frame for picking up the top bag 20 which has opposite side walls, bag top edge portions 20B including front and rear corner portions 20X defining a bag mouth and a bottom edge portion 20E that defines a bag bottom when the bag is filled from a vertical stack S of generally horizontal, flat folded paper bags on a magazine 17, a feeder assembly 15 for feeding the picked up folded bag into a positioner assembly 13 at the positioner station P to be properly aligned in a vertical condition, a carriage assembly C for clampingly engaging the aligned bag, opening the bag and carrying the bag to a bag filling station F, a shaker and saddle assembly X at the filling station for shaking the filled bag to settle product in the bag during the time it is being filled; and a transfer assembly T for gripping the closed filled bag before it is released by the carriage assembly and supportingly moving the filled closed bag away from the filling station F and releasing the filled bag at the discharge station D at the front of the frame; each of the above numeral designations, except reference number 20, being generally designated.

The frame 11 includes a pair of front uprights 24, rear uprights 22, 23, lower longitudinal channels 27, 28 and upper longitudinal channels 29, 30 extending between and joined to the front and rear uprights on the respective side of the machine, upper transverse channels 31 extending between and joined to the front and rear uprights respectively, longitudinally intermediate uprights 33, 32 extending between and joined to the respective set of longitudinal channels 27, 29 and 28, 30 respectively, a channel 35 joined to uprights 22, 33 and upper longitudinal, transversely intermediate channels 38 extending between and joined to transverse channels 31, 31.

Figure 6:
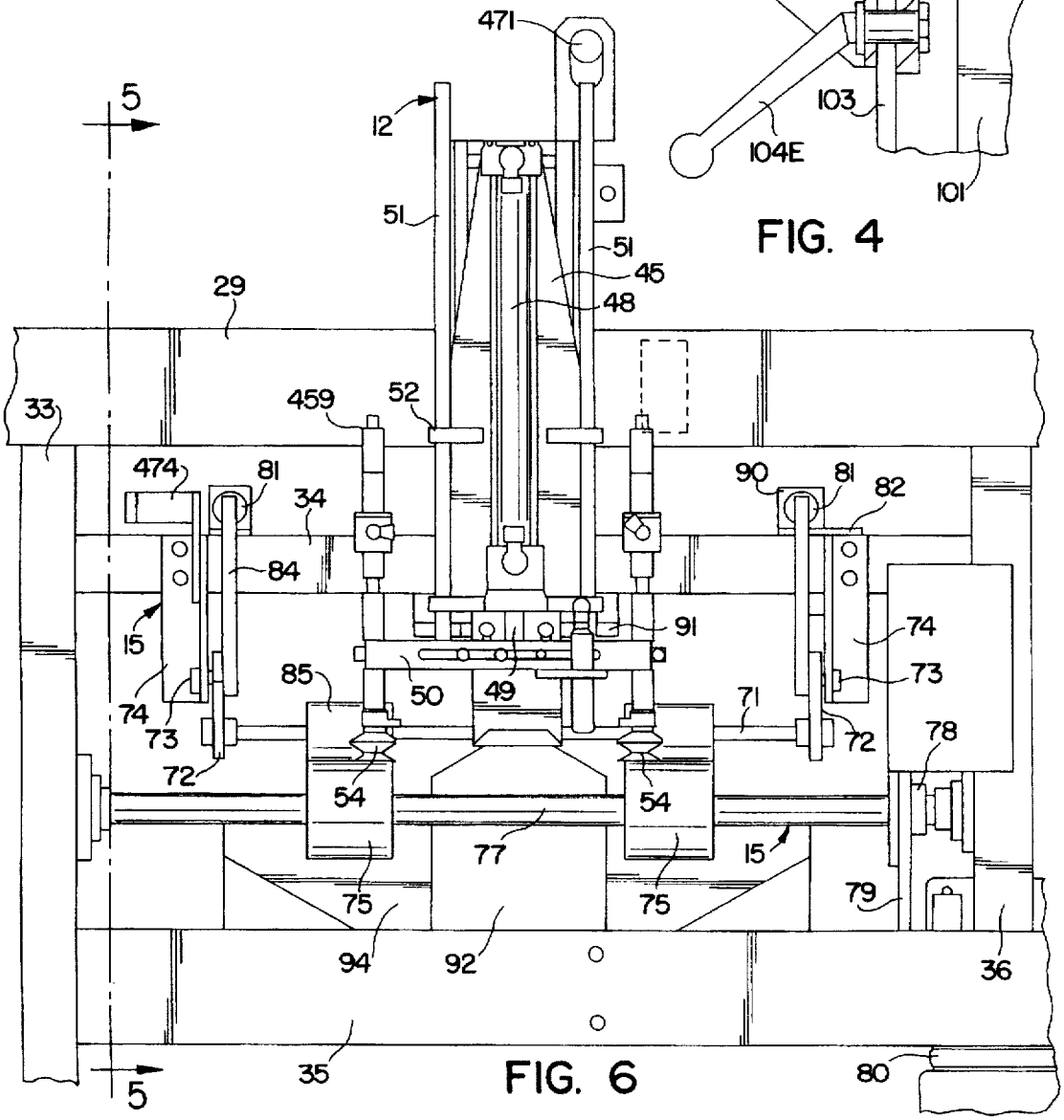
FIG. 6 is a side view of the bag pick up and feed assemblies.
Figure 5:
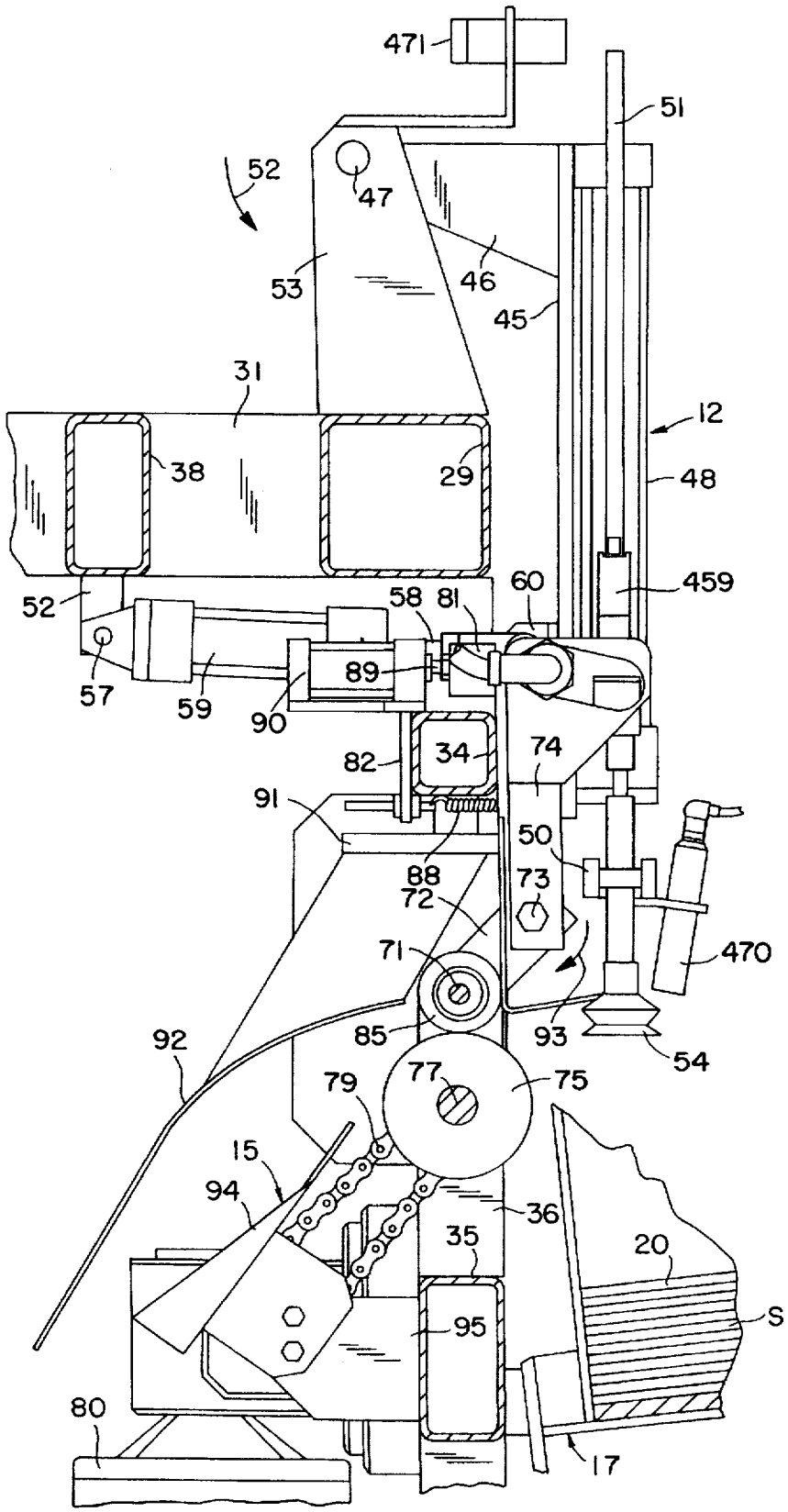
FIG. 5 is a fragmentary transverse cross sectional view of the bag pick up and feed assemblies that is generally taken along the line and in the direction of the arrows 5—5 of FIG. 6 together with a fragmentary part of the bag magazine, said view showing the bag pick up-assembly in its elevated position.

Referring in particular to FIGS. 1A, 5 and 6, the bag pick up assembly 12 includes a mounting plate 45 that at its upper end is fixed to the one end of the arms 46, the opposite end of which are pivoted at 47 to the bars 53 which in turn are mounted by channel 29. The cylinder 48 of the piston cylinder combination 48, 49 is mounted to plate 45 while the piston rod 49 mounts a longitudinal adjustable clamp mount 50. The opposite ends of mount 50 dependingly mount vacuum cups 54 while guide rods 51 are joined to mount 50 and slidably extended through slide clamps 52 which are mounted by plate 45.

Figure 26:
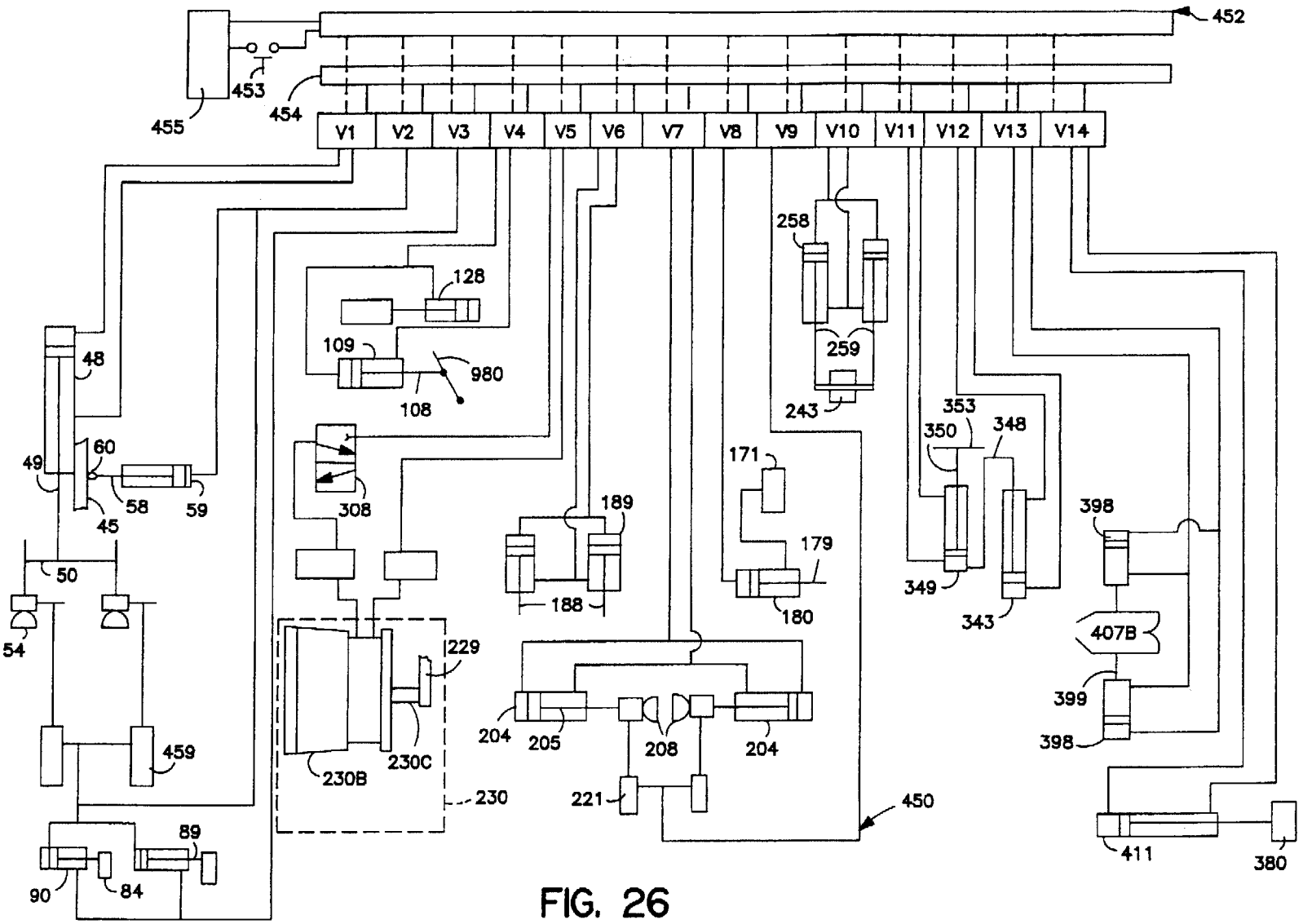
FIG. 26 is a schematic showing of the controls and components.

For pivoting the mounting plate 45 from a position to pick up a flat folded bag 20 from the top of a stack S on the magazine to a position to feed the picked up bag to the feed assembly 15, there is provided a transverse piston cylinder combination 58, 59 that has a piston rod 58 pivotally attached at 60 to the mounting plate (also see FIG. 26). The cylinder 59 is pivotally connected at 57 to a lug 52 joined to the channel 38 which is adjacent channel 29.

The magazine 17 may be, for example, the same as that described in either of U.S. Pat. Nos. 4,133,254 or 4,561,238 and thus will not be further described.

Referring to FIGS. 1A, 5 and 6, the feed assembly 15 includes a pair of drive rollers 75 keyed to shaft 77 to be rotated about a longitudinal axis. Opposite ends of the shaft are mounted by uprights 33, 36, a sprocket 78 keyed to the shaft being driven by a chain 79 which in turn is driven by a sprocket (not shown) keyed to the output shaft (not shown) of the feed motor reducer combination 80. The combination 80 is mounted to the channel 35 and is continuously driven as long as the machine is being driven.

Cooperating with the driven rollers 75 are a pair of longitudinally spaced idler rollers 85 which are mounted by a shaft 71. Shaft 71 is mounted by the one ends of pivot arms 72, the opposite ends being pivotally mounted by pivots 73. The pivots 73 are mounted to the lower ends of brackets 74 which are dependingly connected to longitudinal channel 34. The channel 34 is mounted to channels 33, 36 vertically intermediate channels 29, 35. The lower ends of operator arms 84 are secured to the arms 72 to pivot the arms 72 therewith. Spring stud combinations 88 are connected between the cylinder mounts 82 and the intermediate portions of arms 84 to resiliently retain the upper ends of the arms 84 in abutting relationship to the bumpers 81 that are mounted to the piston rods 89 of the piston cylinder combination 89, 90. The cylinders 90 are mounted by the cylinder mounts 82 to channel 34. The piston rods 89 in being extended pivot the arms 72, 74 in the direction of arrow 93 about pivots 73 to move the rollers 85 out of abutting relationship with rollers 75 in a direction upwardly and away from the magazine while the spring stud combinations 88 resiliently urge the rollers 85 to pivot into abutting relationship with the rollers 75.

A bracket 91 is dependingly mounted to a channel 34 to in turn mount an upper infeed guide 92 that is transversely downwardly inclined in a direction toward the positioner assembly. The upper longitudinal edge of the upper guide is above and adjacent to the exit nip of the rollers 75, 85 when the rollers are in there abutting relationship. The upper guide overhangs the lower bag guide 94 which is inclined downwardly toward the positioner assembly. The lower guide is mounted by a bracket 95 which in turn is mounted by channel 35.

Referring to FIGS. 1A, 2–4 and 24, the bag positioner assembly 13 includes a first and a second bag side wall support members 98 (generally designated), 99 that are transversely spaced. Plates 100 are mounted to plates 97 which depend from channels 27, 28. Flanges 101 are joined to plates 100 and the support member 99. The first support member 98 has a lower portion 98B that includes vertically elongated pivot mounts 110 that have their lower end portions joined to plates 100. The positioner lower portion 98B also includes guide bars 125 mounted by longitudinal spacers 126 which in turn are mounted to the pivot mounts 110. The edges 110B of the pivot mounts 110 and the corresponding edges of the guide bars, which are adjacent to the support member 99 and in part define the lower portion of the support member 98, are generally coplanar and transversely spaced from the generally planar surface of support member 99.

A bracket 104 is mounted to support member 99 for vertically adjustable movement by a clamp plate 104B, a bolt 104C and a clamp handle 104E, a part of the clamp handle 104E extending through a vertically elongated slot 103 in the support member 99 with the clamp plate and bracket abutting against opposite sides of the support member 99. By rotating the clamp handle in one direction the bracket may be vertically moved relative to the support member 99 while rotating it back in the opposite direction the bracket 104 is clampingly held in a fixed position relative to the support members. A bag stop 477 is provided between members 99 and 110, 125, and is joined to the upper edge of clamp plate 104B to move vertically therewith for adjustment for different length bags. A switch actuator 102 is mounted to the bracket 104 by a pivot 105 to, in a datum position, extend through the slot 103 in the support member 99 and a vertical bracket slot 104B, the height of the slot 104B limiting the pivotal movement of the actuator relative to bracket 104 to control the actuation of the proximity switch 114 as will be set forth below. A guide rod 104E is joined to the bag stop 477 longitudinally adjacent to the switch actuator to insure that the bag bottom edge portion 20E of a bag moving downwardly between support members 98, 99 will contact the switch actuator to pivot the switch actuator.

Figure 24:
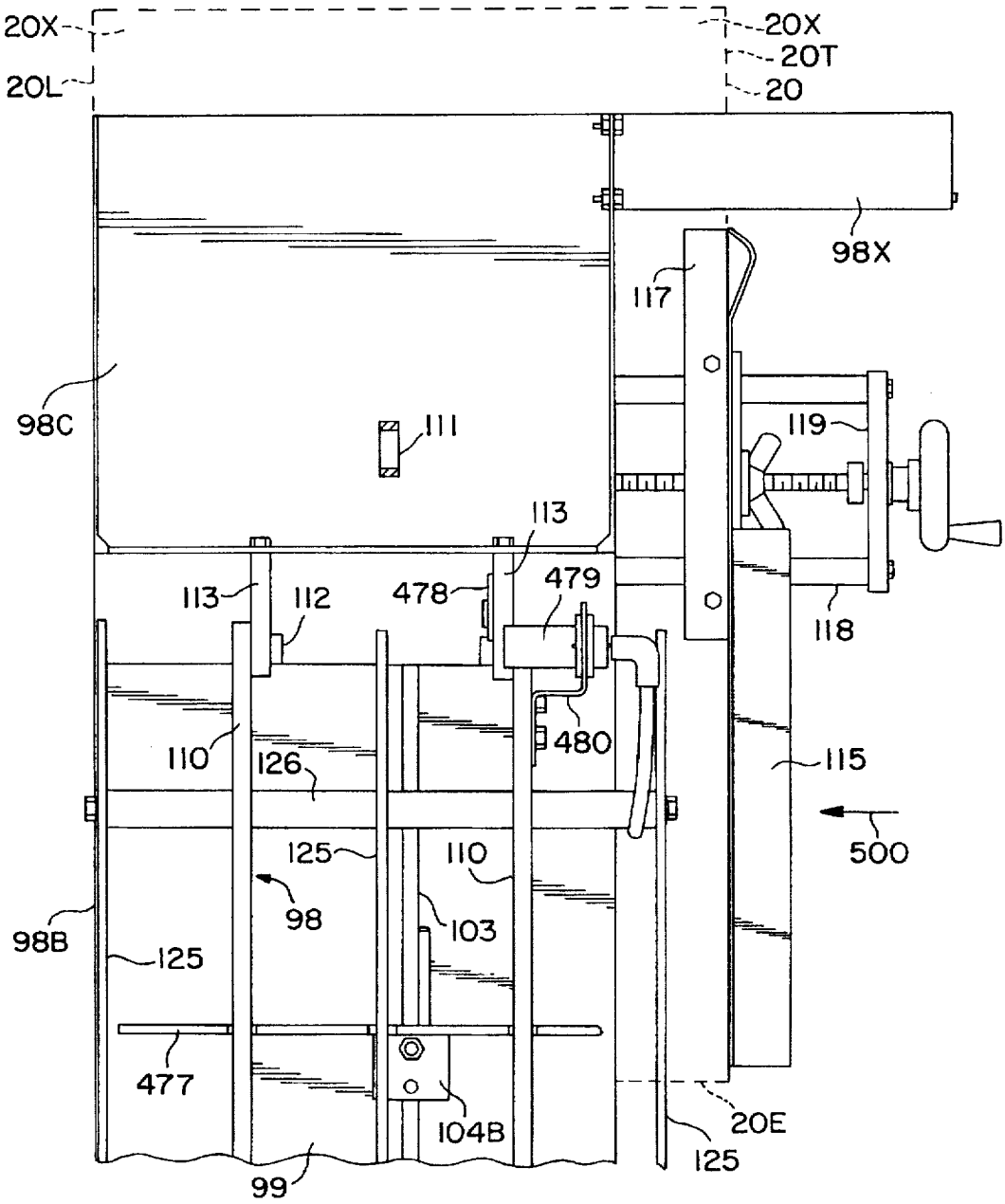
FIG. 24 is a fragmentary view of the position assembly with the chute shown in a closed position and the piston rod not being shown, said view being generally taken along the line and in the direction of the arrows 24—24 of FIG. 3.

Referring to FIG. 24, the support member 98 includes an upper chute 98C which at its lower end is mounted to brackets 113, the brackets being pivotally connected at 112 to the upper end portion of the pivot mounts 110 to pivot about a longitudinal axis between an open position inclined upwardly toward channel 34 to receive a bag sliding off the lower bag guide 94 and a vertical closed position to cooperate with the lower support member portion 98B and support member 99 to retain a flat folded bag in a generally vertical condition between support members 98, 99 with the top edge portions of the bag extending above the support members. A right angle flange chute extension 98X is bolted to a corresponding flange of the chute to extend rearwardly while a corresponding extension 99X is likewise bolted to the right angle flange 99F of the upper portion of support member 99. The support members with, the support member portion 98C in its vertical condition, have generally planar, vertical surfaces adjacent one another and are spaced sufficiently to have a flat folded bag support therebetween. To move the chute 98C between its positions, a piston rod 108 is pivotally connected at 108C to a bracket 111 that is mounted to the chute while the cylinder 109 of the piston cylinder combination 108,109 is pivotally connected 109C to a bracket that is mounted to the channel 124. Channel 124 extends between channels 27, 35.

To properly align a bag that is between the support members 98, 99 to be clamped by the carriage assembly in its rearwardmost position, a bag guide (squaring point) 115 is dependly mounted to a vertical bag guide 117 which is longitudinally adjustable along the parallel square shafts 118. The rear ends of the shafts 118 are joined to the tie bar 119 while the opposite ends are joined to the parallel rails 121 to form generally straight line, longitudinal extensions of the shafts 118. The rail ends opposite the shafts are attached to a tie plate 120. The rails are mounted for longitudinal movement by longitudinally spaced, upper and lower pairs of grooved wheels 122. The wheels are rotatably mounted by a wheel mount 123 which in turn is mounted to support member 99 opposite support member 98. To longitudinally move the rails, the cylinder 128 of the piston cylinder combination 129,128 is pivotally mounted to a cylinder mount 127 which is mounted to the wheel mount. The piston rod 129 is pivotally connected to a bracket 130 which in turn is attached to the rails to move the rails therewith. An adjustment screw 134 is rotatably mounted by the tie bar in a fixed longitudinal position relative to the bar, a hand wheel 133 being keyed to the screw. The threaded part of the screw matingly extends through internal threads (not shown) in bag guide 117 to longitudinally move the guide relative to the shafts 118 as the screw is rotated to longitudinally adjust the bag guides (pusher members) 115, 117 relative to the support members 98, 99 for different width bags.

Figure 1B:
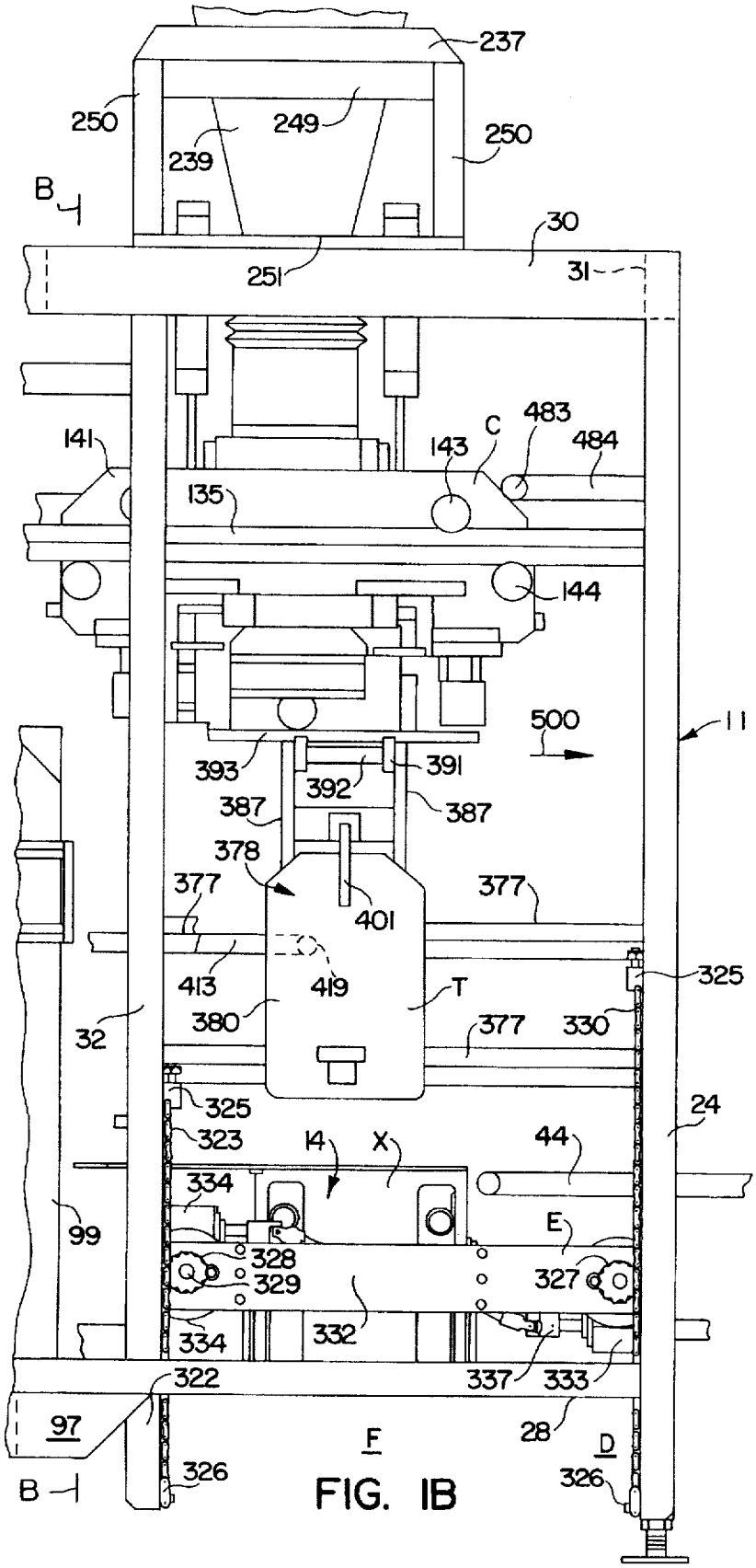
Figure 2:
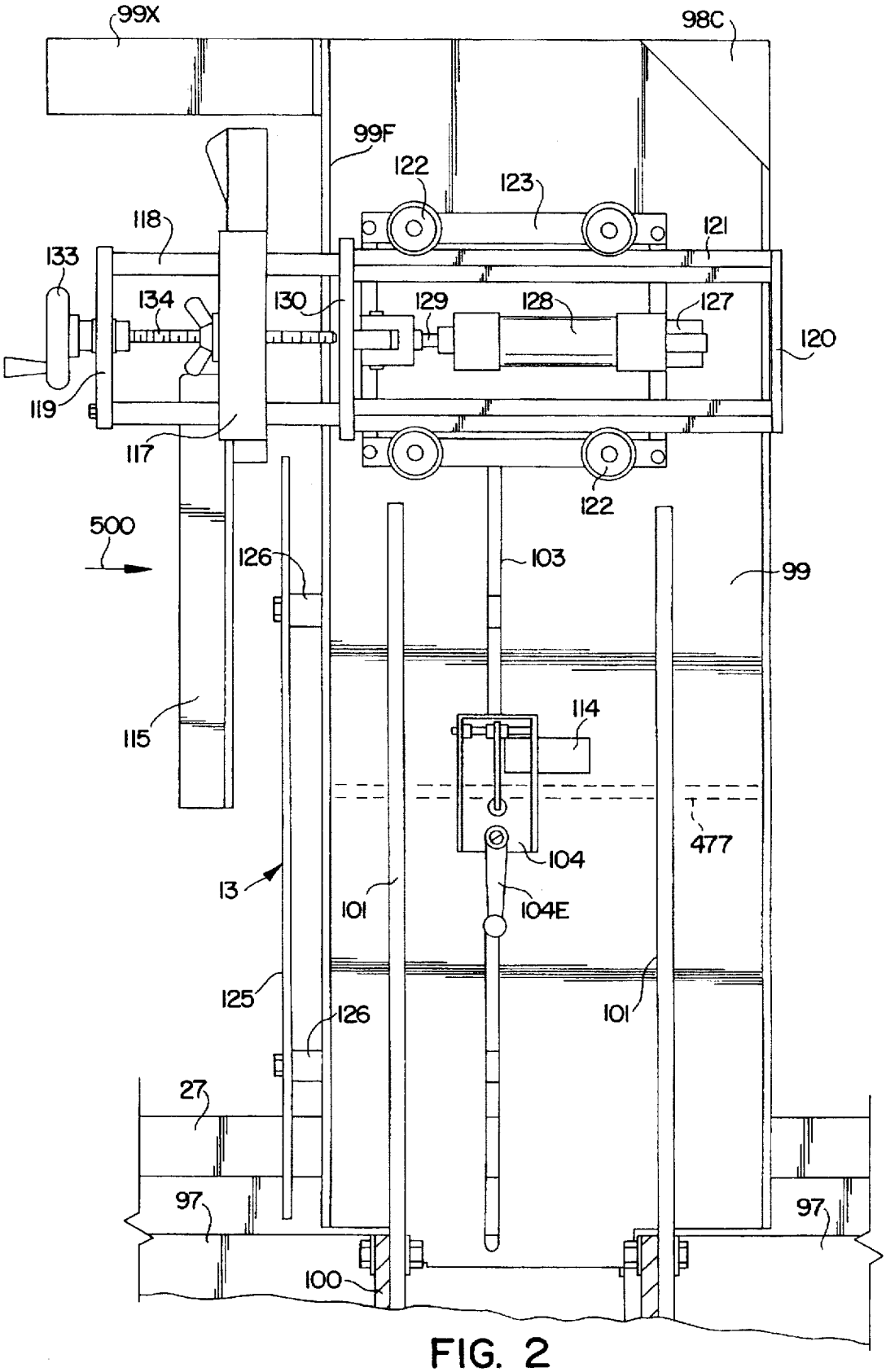
FIG. 2 is a side view of the bag positioner assembly that is generally taken along the line and in the direction of the arrows 2—2 of FIG. 3.
Figure 7:
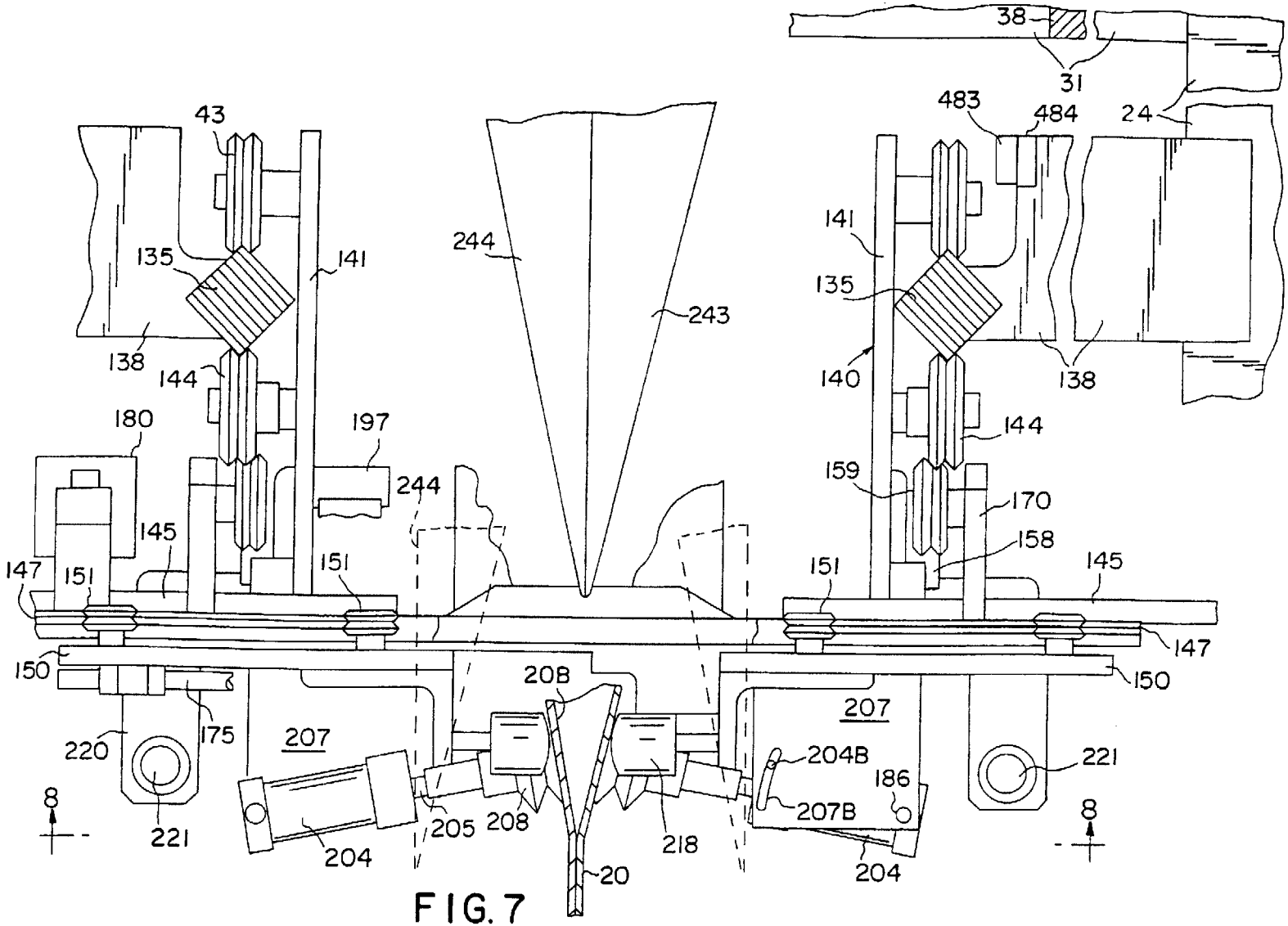
FIG. 7 is a fragmentary transverse cross sectional view of the carriage assembly at the filling station and the lower part of the spout with the spout subassembly being shown in its elevated datum position in solid lines and its lowered, spread apart position in dotted lines, said view looking in a forward direction with many parts being broken away and the opening vacuum cups holding the bag top edge portions in a spread apart condition.

In order to mount the carriage assembly C for movement from the filling station F to the bag positioner station P where it clampingly engages an empty bag that is retained in a vertical position by the positioner assembly, a pair of longitudinally elongated, transversely spaced, diamond shaped rails 135 have their rear ends mounted to the lower ends of bars 136, the bars having their upper ends mounted to channels 38 (see FIGS. 1A, 1B and 7). The opposite ends of the rails are mounted to the one ends of transverse plates 138, the opposite ends of the plates being mounted to the respective adjacent front upright 24.

Referring to FIGS. 7, 8A, 8B and 10–12, the carriage assembly includes a carriage frame, generally designated 140, that has transversely spaced side plates 141. Each side plate mounts front and rear upper and lower grooved wheels 143, 144 for mounting the side plates to the rails 135 for longitudinal movement. Each side plate also mounts a track mount 145 to extend transversely outwardly of the side plates, each track mount mounting front and rear transversely extending tracks 147. A bag opening plate 150 is dependingly mounted to each of the track mounts for transverse movement by front and rear grooved rollers 151 that roll on the respective set of front and rear tracks 147. To the transverse outer end of each of the plates 150, longitudinally spaced spacer devices 152 dependingly mounting longitudinally elongated index plates 153.

To each of the front and rear portions of each of the side plates 141, there is mounted upper and lower longitudinal tracks 157, 158 respectively. Each set of upper and lower tracks mount front and rear rollers 159 for longitudinal movement, each set of front and rear rollers being mounted by a mount 170. The transversely spaced, rear mounts 170 dependingly mount a transversely elongated clamp plate 171 at a lower elevation than the side plates 141 to extend transversely further outwardly than the side plates while the front pair of mounts 170 likewise mount a front clamp plate 171. A plurality of apertures 174 are provided in each end portion of each of the index plates. Further, each transverse end portion of each clamp plate has a plurality of spaced apertures 177, a pivot member 178 extending through the selected aperture 177 in the respective transverse end portion of the clamp plate to pivotally mount one end portion of the respective link 175. The opposite end of each link is pivotally mounted on the respective index pin 173 which is extended through the selected aperture 174 in each respective end portion of the index plates 153. Springs are provided on the index pins to resiliently urge the adjacent ends of the links away from the index plates (toward the clamp plates). Thus, the front pair of links are mounted to converge toward one another in a forwardly direction while the rear pair of links are mounted to converge toward one another in a rearward direction. Due to the provision of multiple apertures 173, 174, the mounting of the links can be varied for different sizes of opening of bags that are to be filled and different size spout subassemblies.

A single bag forming piston cylinder combination 179, 180 is provided for translatorily moving the clamp plates away from one another, the piston rod 179 being pivotally connected at 181 to one transverse end portion of one of the clamp plates while the cylinder 180 is pivotally connected at 182 to the corresponding transverse end portion of the other clamp plate on the same side of the machine. Due to the provision of the rollers 159, the tracks 157, 158 and the mounting of the links 175, the clamp plates are maintained in parallel relationship as they move between their bag clamped and bag released positions by only one piston cylinder combination 179, 180.

Figure 25:
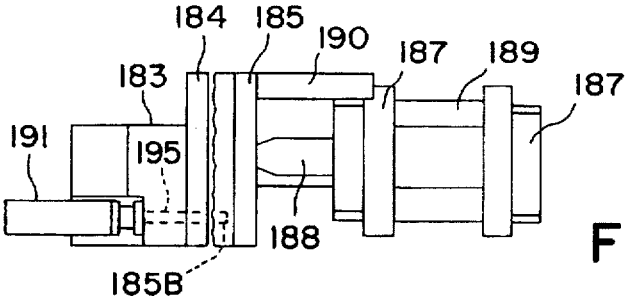
FIG. 25 is a bottom view of a bag clamp corner assembly in a clamped position with no bag being clamped.

To the transverse mid-portion of each clamp plate 171, a switch and clamp mount 183 is dependingly mounted for mounting a bag corner clamp 184 to face a bag corner clamp 185. The bag clamp 185 is mounted by the piston rod 188 of the bag clamp piston cylinder combination 188, 189, the cylinder 189 being dependingly mounted by the respective clamp plate by cylinder mounts 187 (also see FIG. 25). Each piston rod is transversely movably extended through one of the mounts for the respective cylinder. To each bag clamp 185, there is mounted a pair of bag guides 190 to extend away from the adjacent bag clamp 184 and adjacent to one edge of the adjacent cylinder mount to maintain the clamp 185 in proper orientation to clamp 184 as clamp 185 is moved between its extended clamping position of FIGS. 8A, 8B and 10 and a transversely retracted bag release position. A bag guide 193 is mounted to a spacer 194 which in turn is mounted to the rear clamp mount 183 to direct the bag top portion of a bag supported by the positioner assembly that extends above the positioner assembly between the rear corner clamps 184, 185 as the carriage assembly moves to its rearward position above the positioner members 98, 99. A limit switch 191 is mounted to each mount 183.

Figure 8A:
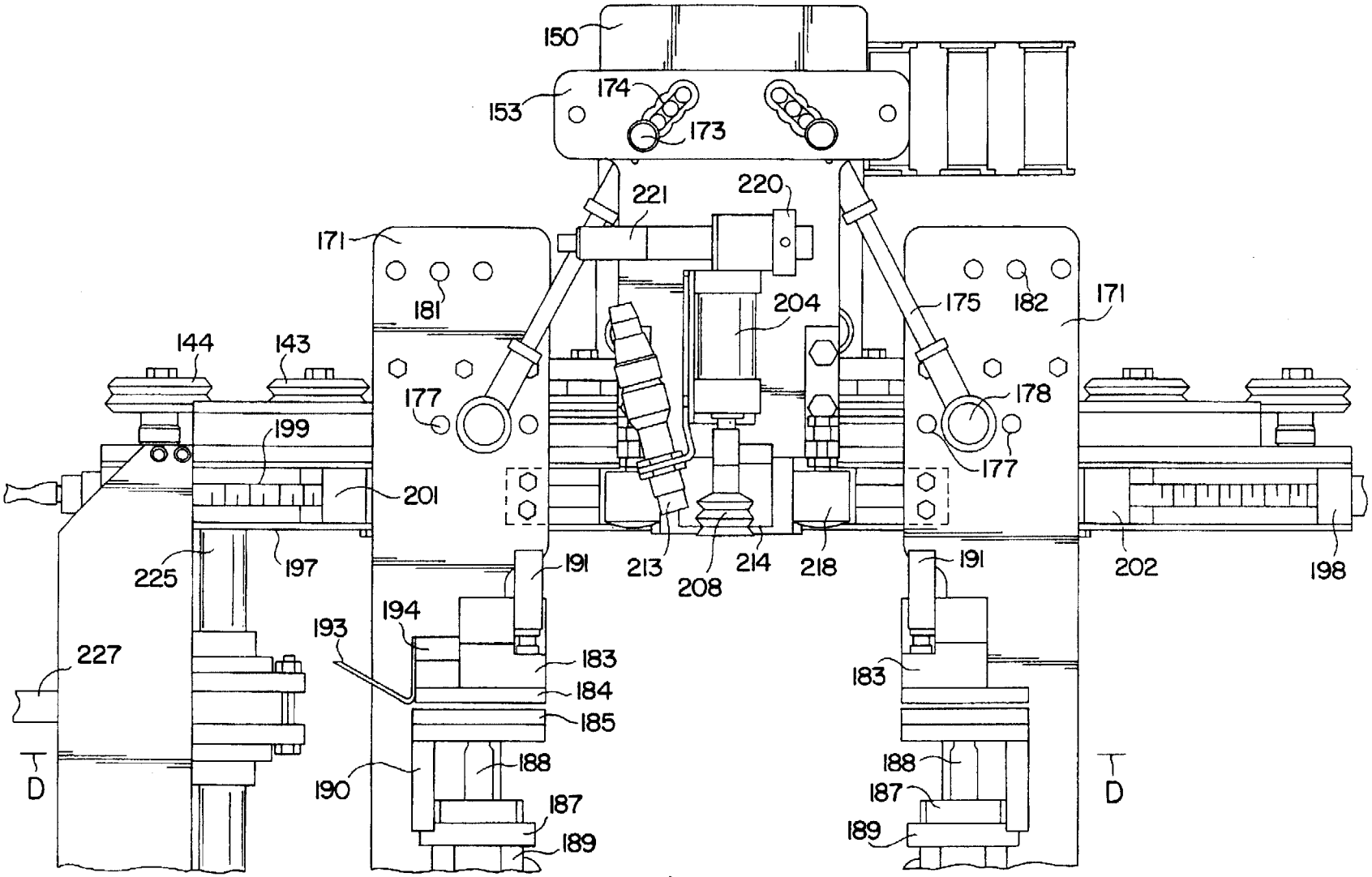
FIGS. 8A and 8B when arranged with lines D—D aligned is a bottom view of the carriage assembly that is generally taken along the line and in the direction of the arrows 8—8 of FIGS. 8 and 10 with various parts not being shown.
Figure 9:
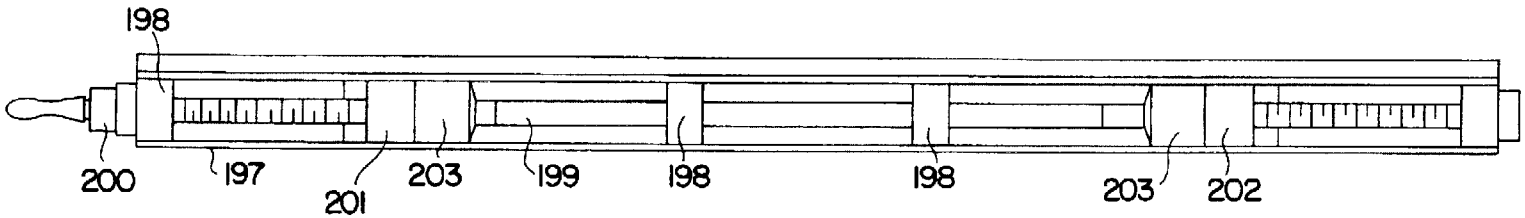
FIG. 9 is a bottom view of the mechanism for adjusting the maximum longitudinal separating movement of the bag clamps.

Referring in particular to FIGS. 8A and 9, to limit and cushion the longitudinal spread apart movement of the clamp plates, a longitudinally elongated guide member 197 is mounted to one of the side plates 141. The guide member mounts a plurality of stop rod mounts 198. The rod mounts 198 rotatably mount a longitudinal stop rod 199 in a fixed axial position relative to the guide member, a hand crank 200 being keyed to the stop rod for rotating the rod. The rod 199 has thread portions for mating with corresponding internal threads of front and rear bumper mounts 202, 201 respectively for moving the rod mounts in opposite directions as the rod is rotated, the guide member preventing the bumper mounts rotating with the rod. Each of the bumper mounts mounts a bumper 203 at an elevation to cushion the stopping of the movement of the clamp plates longitudinally away from one another. The bumpers also serve to limit the maximum longitudinal spacing of the clamp plates 171.

Figure 8B:
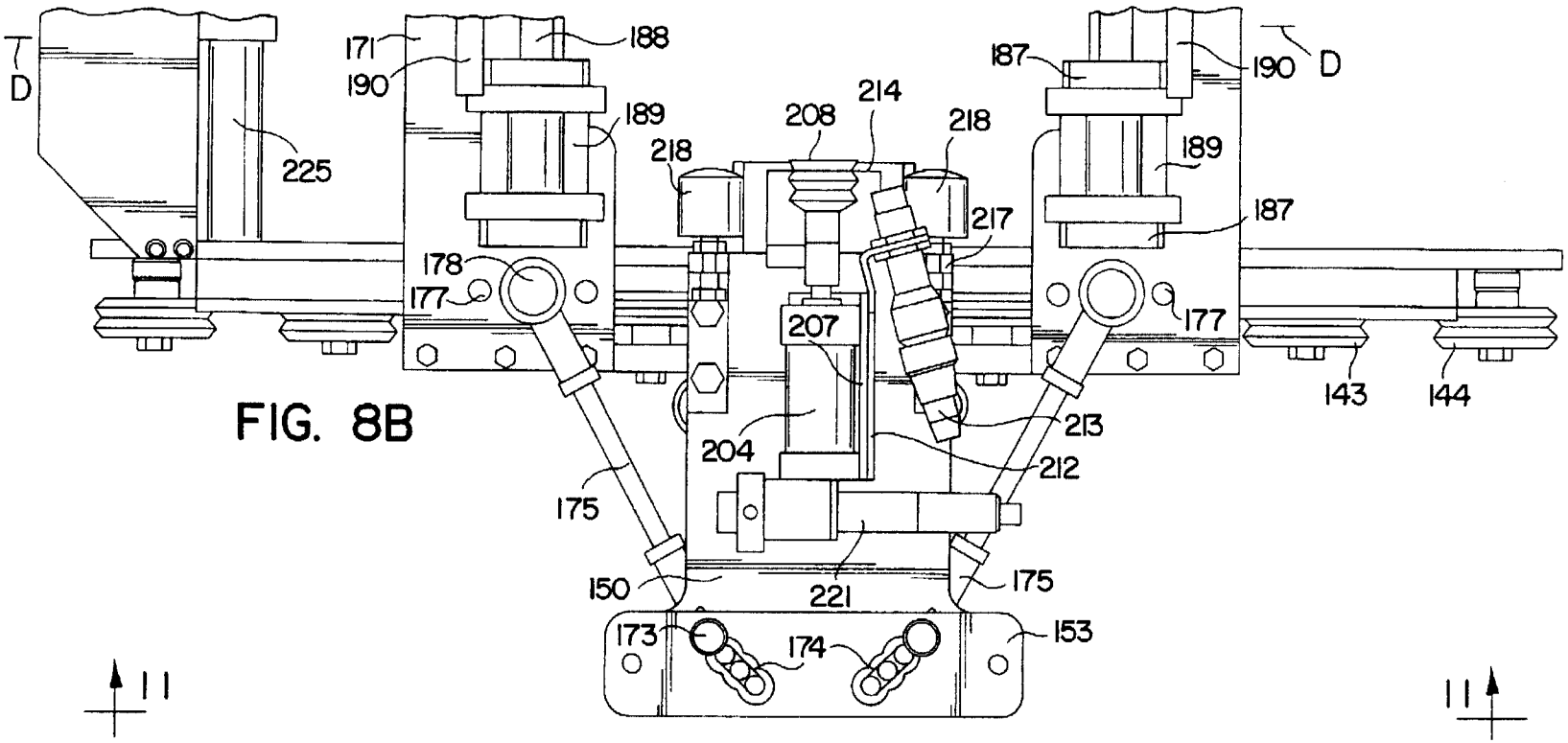

Dependingly mounted to each of the bag opening plates 150 is a cylinder mount 207 to which mounts a cylinder 204 of a piston cylinder combination 204, 205 is pivotally mounted by a pivot 186, the piston rod 205 mounting an accordion type vacuum cup 208 for transverse movement, see FIGS. 7, 8A and 8B. A suitably clamp device 204B extended though an arcuate slot 207B to retain the respective cylinder 204 in an adjusted pivoted position. Also mounted to each cylinder mount 207 is a proximity switch mount 212 which mounts a proximity switch 213 in a position to be actuated by a metal ring 214 on the respective vacuum cup 208 when the cup is retracted and is compressed as the result of vacuumingly gripping the upper central edge portion of the adjacent side wall of a bag that is clampingly held by the bag clamps 184, 185. However when the cup is in its retracted position in a relaxed condition, the ring is sufficiently spaced from the adjacent switch 213 so that the switch is not actuated. To each bag opening plate 150, on longitudinally opposite sides of piston rods 205, an angle bracket 217 mounts a bag opening bumper 218 for abutting against the adjacent bag top edge portion to limit the opening movement of the bag top edge portions of the opposite side walls of the bag prior to the dumping of product into the bag as will be more fully set forth below. The bumpers and cups 208 are mounted at an elevation above the gripper members 394, 395 of the bag transfer assembly. Further, each bag opening plate dependingly mounts a transducer mount 220 which mounts a vacuum transducer 221 for applying a vacuum to the respective vacuum cup 208.

Referring to FIGS. 1A, 1B, 10 and 12, to move the carriage assembly C between its rearwardmost position above an upright bag in the positioner assembly to clampingly engage the upright bag and a forward position at the filling station F for the bag to be filled, there is provided a carriage drive assembly that includes a longitudinally elongated bar 227 which at one end is pivotally connected by a bearing 224 to rod 225. Rod 225 is mounted to the upper rear portions of the side plates 141. The rear end of the bar 227 is pivotally connected at 228 to one end of a crank arm 229, the opposite end of the arm being keyed to the output shaft 230C of the carriage motor clutch/brake reducer combination 230. The combination 230 is mounted on a mounting bracket 231 which in turn is mounted by a transverse rear channel 232, the channel being mounted to channel 35.

Figure 13:
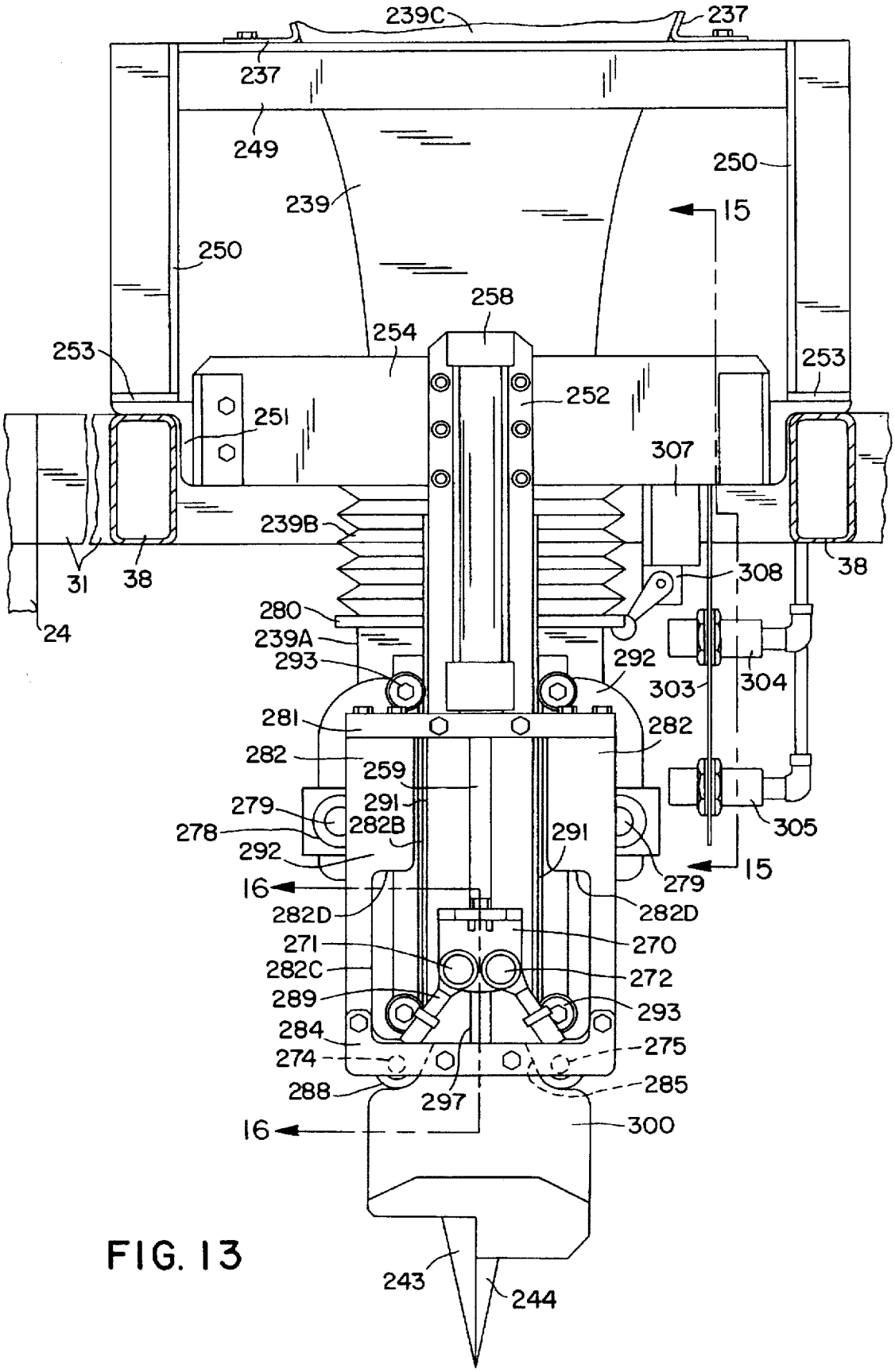
FIG. 13 is an end view of the hopper spout assembly with the spout subassembly in its lowered closed position, said view being generally taken along the line and in the direction of the arrows 13—13 of FIG. 14.
Figure 14:
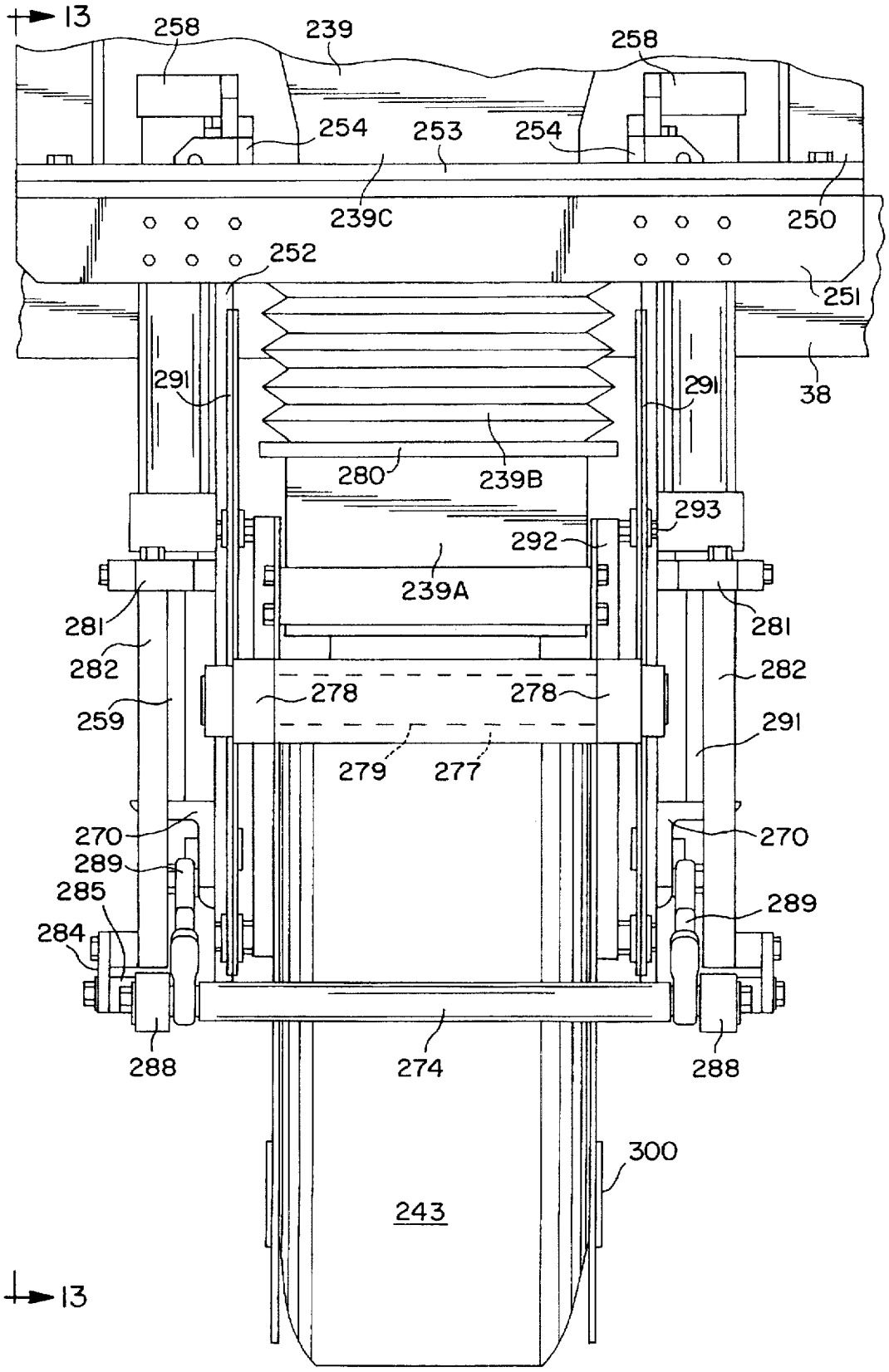
FIG. 14 is a side view of the hopper spout assembly with the spout subassembly in the position shown in FIG. 13.
Figure 21:
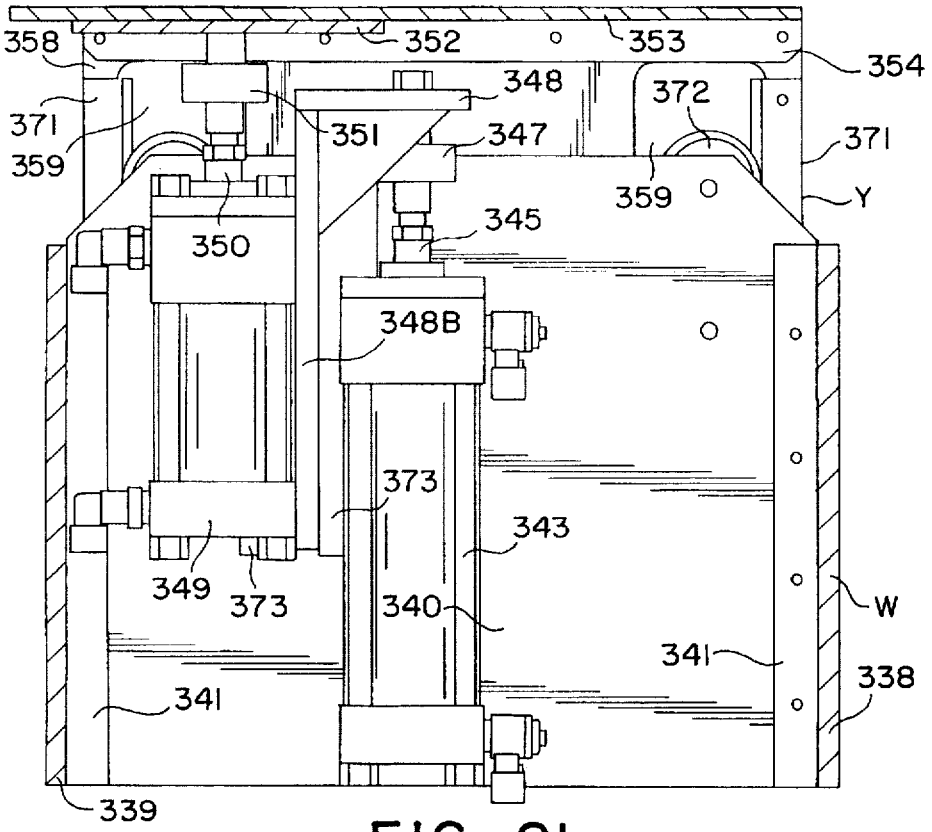
FIG. 21 is a longitudinal cross sectional view that is generally taken along the line and in the direction of the arrows 21—21 of FIG. 22.

Referring in particular to FIGS. 1B, 13 and 14, adjacent the front end of the frame, a hopper 239 has its upper portion 239C mounted in a fixed position to angle irons 237 that in turn are mounted to an open rectangular mount 249 having the hopper extending downwardly therethrough. The hopper mount 249 is mounted to the upper ends of upright angle irons 250. The angle irons 250 in turn are mounted to transverse plates 253 that are mounted to longitudinal angle irons 251 which are mounted to longitudinal channels 38.

A spout subassembly is mounted to vertically elongated, front and rear parallel spout mounting plates 252 which in turn are mounted to transverse plates 254. Plates 254 are mounted by angle irons to angle irons 251. Each plate 252 mounts a cylinder 258 of a piston cylinder combination 258, 259, the piston rod 259 dependingly mounting a spout link mount 270. Each of the mounts 270 mounts a pair of pivot member 271, 272 having parallel longitudinal pivot axes. Each of the pivot members 271, 272 respectively pivotally mounts one end of a link 289, the rear and front pair of links 289 at their opposite ends pivotally mounting transversely spaced spout jaw opening rods 274, 275. Each of the rods 274, 275 is joined to the vertical mid-portion of the respective spout jaw 243, 244. The opposite ends of each of the rods 274, 275 rotatably mounted a roller 288 to move vertically along the adjacent roller rail 282 to retain the jaws closed or to close the jaws. Adjacent to the rollers 288, each of the rods 274, 275 mounts the one ends of links 289.

The upper end portion of each jaw is pivotally mounted by a pivot member 279 to a pivot mount 278 and stop members 277. Members 278 are mounted to a vertically movable hopper portion 239A. The stop members 277 in abutting against the bumpers 235 (FIG. 10) limit the downwardly movement of the lower hopper portion 239A relative to the carriage assembly C and the fixed hopper portion 239C. Application of fluid under pressure to the lower ends of the cylinders 258 move the spout jaws and hopper portion 239A to move upwardly from the position shown in FIGS. 13 and 14. The upper end of the lower hopper portion 239A is clamped by clamp mechanism 280 to the lower end of the hopper bellows 239B, the upper end being clamped to the lower end of the fixed hopper portion 239C. The piston cylinder combinations 258, 259 permit limited vertical movement of the lower hopper portion relative to the upper hopper portion.

To the mid-portion of each of the mounting plates 252, there is mounted a transverse roller rail mount 281 which at its opposite ends dependingly mounts oppositely faced roller rails 282. The rails have upper, adjacent vertical edge portions 282B, lower, vertical edge portions 282C that are more remotely spaced than edge portions 282B and are parallel to one another and generally transverse edge portions 282D extending between the respective set of edge portions 282B, 282C. To the lower ends of the front roller rails there is attached a roller stop mount 284 while likewise to the rear roller rails there is attached a stop mount 284. To each of the stop mounts 284 there is mounted a roller stop 285 there has transversely opposite edge portions that converge toward one another in an upward direction, the stops cushioning the movement of each set of the front and rear rollers 288 toward one another. Shield plates 300 may be dependingly mounted to the front and rear parts of the movable hopper portion 239A for use with other than poly and sewn open mouth bags, the shields not extending sufficiently downwardly to interfere with the filling of bags.

To each of the front and rear walls of the movable hopper portion 239A is a wheel mounting plate 292 mounting upper and lower grooved wheels 293 to roll along tracks 291. Opposite vertical edges of the cylinder mounting plates 252 mount the tracks 291. In addition to the wheels 293 acting to ensure the proper movement of the rollers 288 for controlling the opening and closing of the spout jaws, a spout slide bushings 295 is mounted to each spout link mount 270 to extend into the vertical guide slot 297 in the adjacent cylinder mounting plates to ensure vertical movement of the piston rods 259 (also see FIG. 16).

A proximity switch mount 303 is mounted to one of the plates 254 for mounting spout up and down proximity switches 304, 305. A limit switch mount 307 is mounted to one of the plates 254 for mounting a limit switch operated valve 308 in a position to be operated by the vertical movement of the vertically adjacent pivot mount 278.

Figure 17:
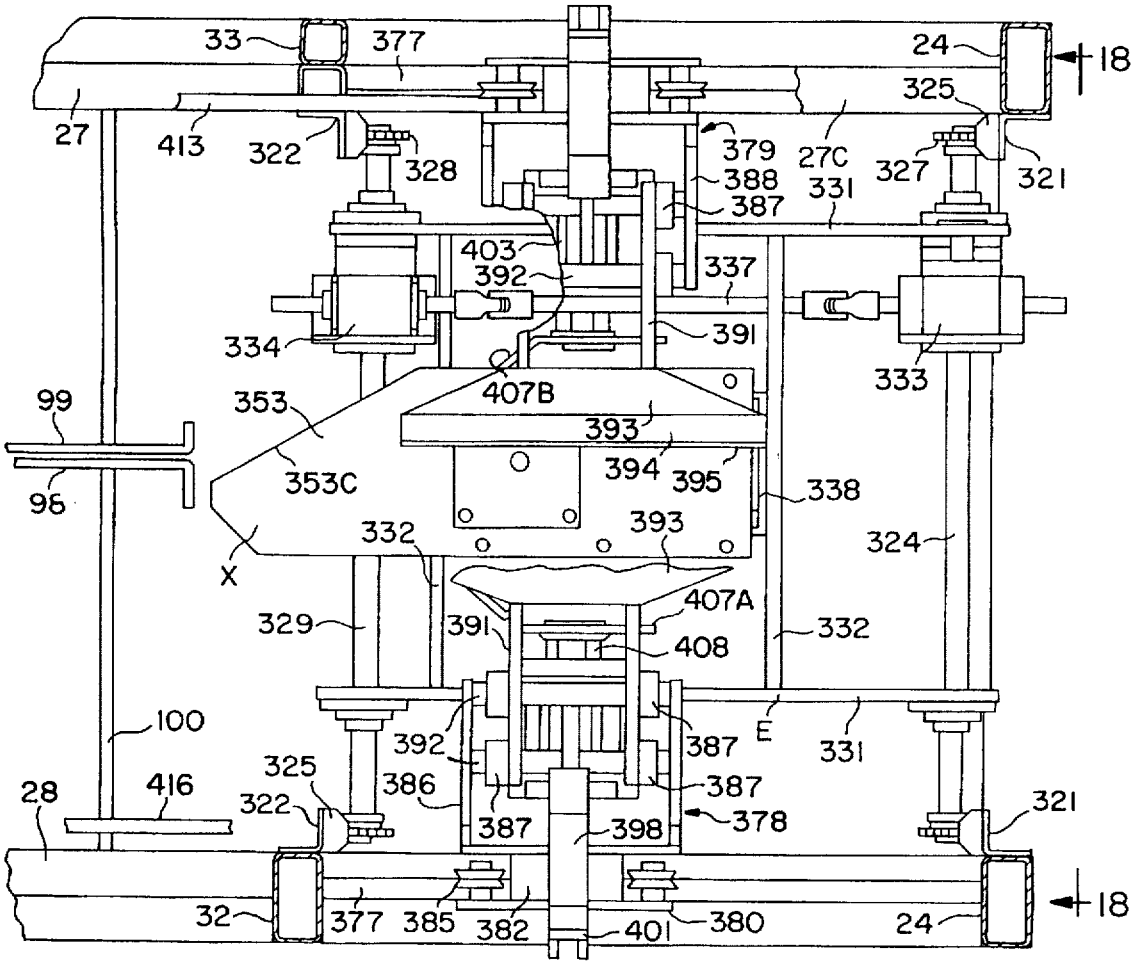
FIG. 17 is a plan view taken below the top main frame members which shows the shaker saddle assembly and the transfer pusher assembly in its rearward position with various parts not shown.
Figure 18:
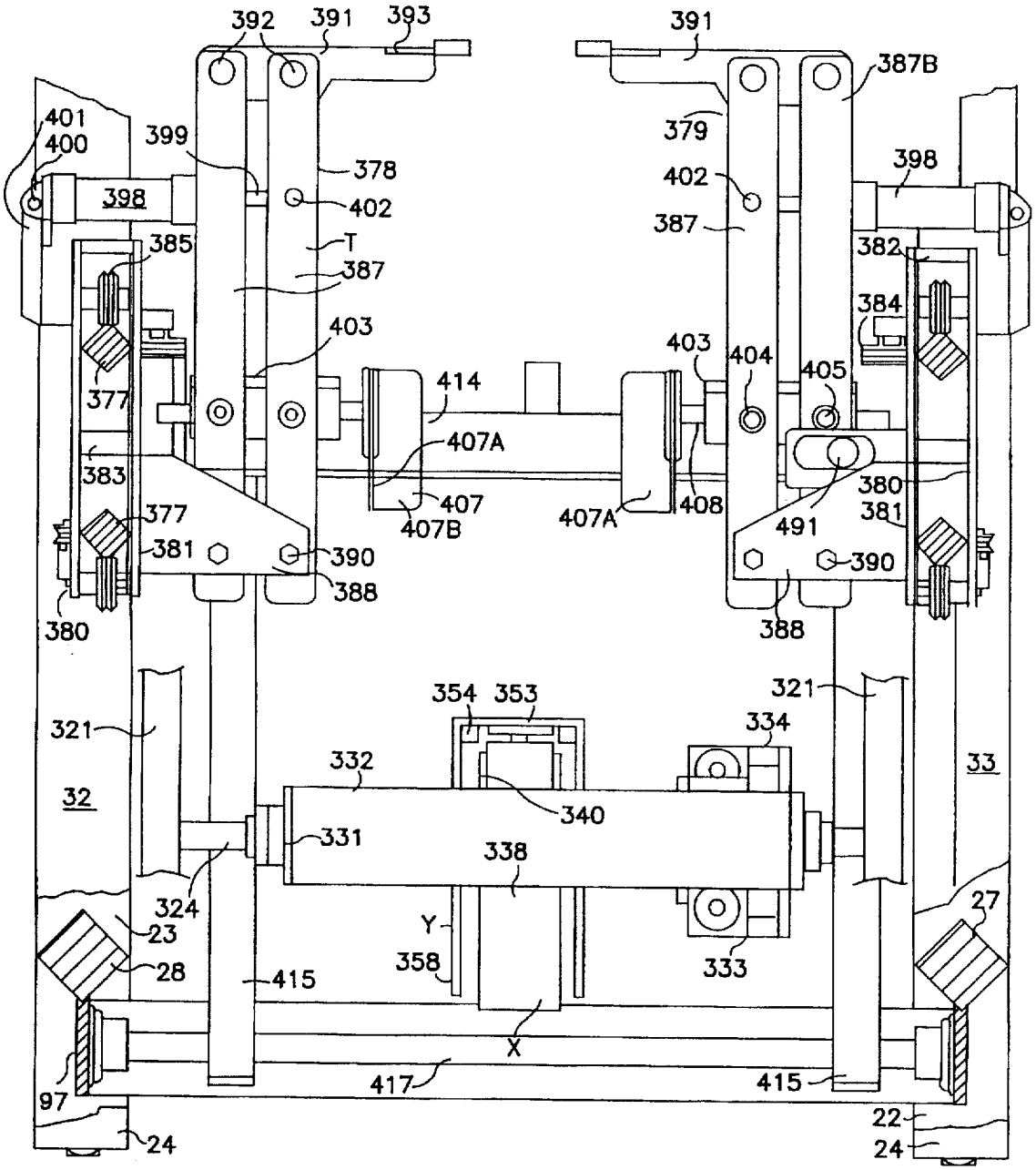
FIG. 18 is a front end view generally taken along the line and in the direction of the arrows 18—18 of FIG. 17 with various parts broken away.
Figure 20:
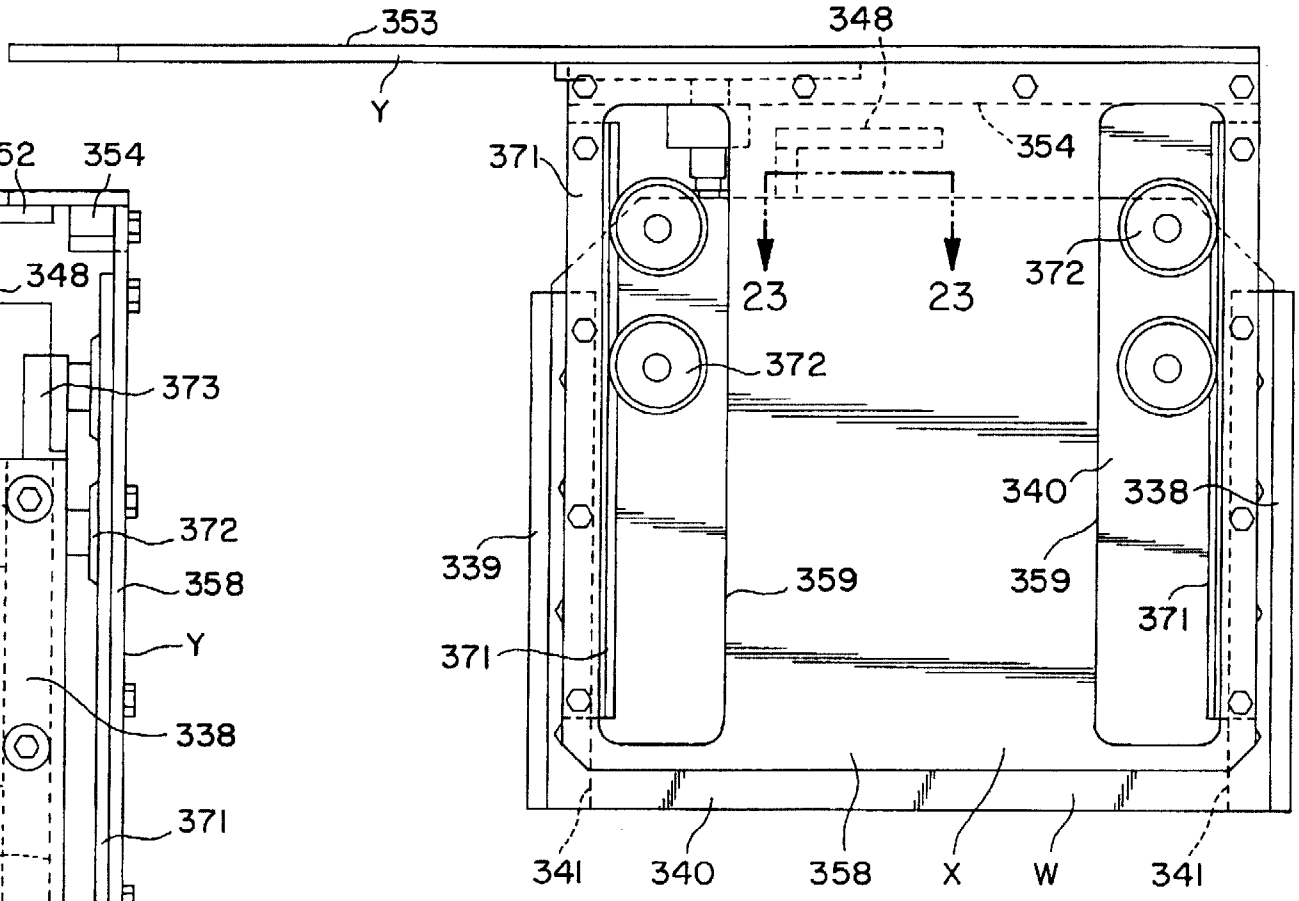
FIG. 20 is a side view of the shaker saddle assembly.
Figure 19:
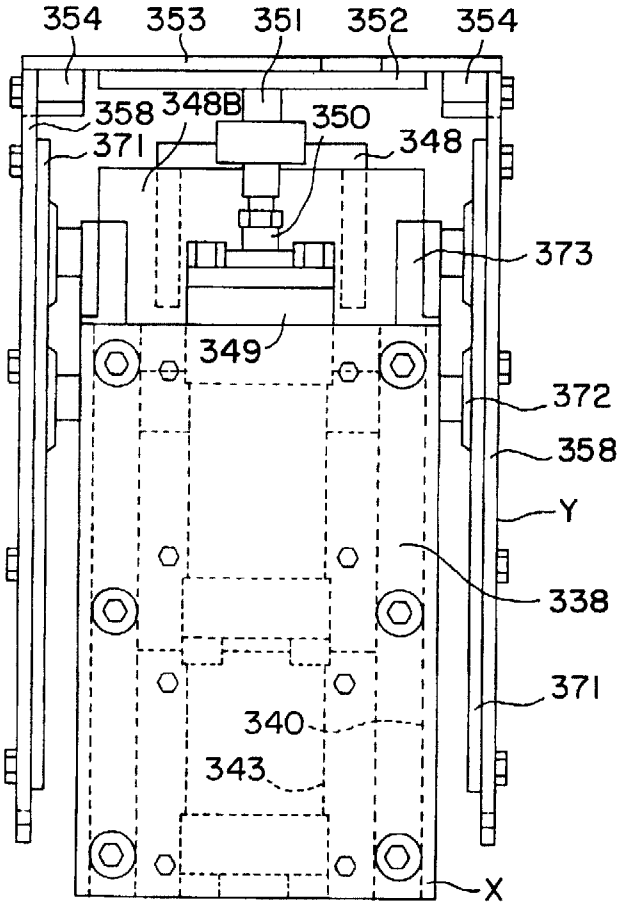
FIG. 19 is a rear view of the shaker saddle assembly with the saddle subassembly in its lowered position relative to the shaker subassembly.

Referring to FIGS. 1B, 17 and 18, the elevating mechanism E for adjustably varying the height of the bag shaker and shaker assembly X for different height (length) bags includes vertical, front angles 321 mounted to the channels 24 and rear angles 322 mounted to channels 32, 33. Each of the angles 321, 322 mounts upper and lower chain mounts 325, 326 respectively. Each set of rear chain mounts mounts a linear length of a link chain 323 while each set of front mounts mounts a linear length of a link chain 330. Front sprockets 327 are keyed to a connecting shaft 324 to engage the front chains 330 while rear sprockets 328 are keyed to a rear connecting shaft 329 to engage the rear chains 323. The shafts mount longitudinally elongated side plates 331 to move vertically therewith as the shafts are rotated in opposite directions, the side plates being retained in transverse spaced relationship by front and rear transverse plates 332.

Conventional gear reducer members 333, 334 are mounted by one of the side plates 331 to drivingly rotate the respective connecting shaft 324, 329 which extends therethrough, a hand crank ratchet device (not shown) being mounted by the front reducer member 333 for operating front member 333 to rotate shaft 324. A drive connection 337 which includes a pair of universal joints are extended between the reducer members to transmit a driving force from the front reducer member 333 to operate member 334 to rotate the rear shaft 329 in the opposite angular direction from the rotation of the shaft 324 as the hand crank device is rotated. As the shafts 324, 329 are rotated, the rotation of the sprockets result in the elevation of the elevating plates 332 being varied.

Referring to FIGS. 1B, 17 and 19–22, the saddle and shaker assembly X includes a shaker subassembly W having a shaker frame that in part is formed by front and rear end plates 338, 339 that are mounted to the front and rear elevating plates 332,329 respectively and side plates 340 mounted to end plates 338, 339 by vertical bars 341 to form a rectangular open top frame. Shaker cylinder mounts 342 are mounted to the side plates 340 for mounting the cylinder 343 of the shaker piston cylinder combination 345, 343. Alignment mechanism 347 mounts the saddle cylinder mount 348 of the saddle subassembly Y to the piston rod 345 to permit properly aligning the mount 348 relative to the cylinder 343. The saddle cylinder mount mounts the saddle piston cylinder combination 350, 349 whereby when the piston rod 345 is in a retracted position, the top of the cylinder 349 is at a higher elevation than the top of the cylinder 343 and the bottom is at a lower elevation than the top of cylinder 343. The cylinder mount 348 includes a plate portion 348B abutting against front and rear guides plate 373 which are mounted to plates 340 to maintain the cylinder 349 in a vertical condition as it is moved between its lowered position and its elevated position. Rod alignment mechanism 351 mounts the saddle mount 352 of saddle subassembly Y to the saddle piston rod 350 while the horizontal top saddle plate 353 is mounted to mount 352 to extend beneath the spout assembly even when both of the piston rods 345, 350 are in their extended positions and to extend longitudinally both forwardly and rearwardly of the spout assembly.

To maintain the top saddle plate in a generally horizontal condition, it is moved vertically by extension and retraction movement of one or both of the piston rods 345, 350, longitudinal support bars 354 are dependingly mounted to the top saddle plate 353 for mounting saddle side plates 358 on transverse opposite sides of the shaker frame. The forward and rearward end portions of each saddle side plates has a generally rectangular slot 359 that extends the major part of the height of the plate. Vertical tracks 371 are mounted to the side plates 358 to, as viewed from the side of the machine, overlap the respective slot 359. Each upper corner end portion of the shaker side plate 340 mounts a pair of vertically spaced, grooved wheels 372 to extend into the adjacent slot 259 and rotate in engagement with the adjacent track 371 to aid in maintaining the top saddle plate in a horizontal condition while permitting limited vertical movement of the saddle side plates relative to the shaker side plates.

Referring in particular to FIGS. 1A, 1B, 17 and 18, in order to mount the transfer assembly T and move it from the solid line position of FIGS. 1A, 1B to a position to move a filled bag from beneath the spout at the filling station to a position more closely adjacent to the uprights 24 and unto a discharge conveyor 44 (only partially diagrammatically shown) at the discharge station D, at each side of the main frame there is provided a pair of longitudinally elongated rails 377 extending between uprights 24, 32 and 24, 33 respectively. The transfer assembly includes a transfer subassembly, generally designated 378, mounted for longitudinal movement on rails 377 on one side of the main frame and a transfer subassembly, generally designated 379 mounted for longitudinal movement on the rails transversely opposite subassembly 378. Since the subassemblies are the same, except one is a right hand subassembly and the other a left hand assembly, primarily only the structure of the subassembly 378 will be described.

The subassembly 378 includes vertical mounting plates 380, 381 on the opposite transverse sides of the rails that mount upper and lower grooved wheels 385 to run on the rails for horizontal movement. Additional grooved wheels 384 are provided to run on side edges of the rails to oppose forces tending to rotate the mounting plates 380, 381 about longitudinal axes. Spacers 382, 383 are mounted to plates 380, 381. Front and rear sets of parallel arms 387 at their lower ends are pivotally connected at 390 to brackets 388. The brackets are mounted to mounting plate 381 to extend transversely toward the opposite plate 381. A horizontal arm 391 is pivotally connected at 392 to the upper ends of each set of front and rear parallel arms to have the inner end of the respective arm 391 extend toward the opposite side of the main frame. Each set of front and rear arms 387 and the pivots 390, 392 of the respective subassembly form a parallel linkage mounting of the horizontal arms 391. The inner ends of the arms 391 Of each subassembly 378, 379 mount a longitudinally elongated plate 393 which in turn mount upper and lower clamp plates 394 (also see FIG. 10). The clamp plates mount an elongated resilient gripper member 395 therebetween to extend transversely inwardly to, in cooperation with the gripper member of subassembly 379, grippingly engage opposite side walls of a filled bag at the filling station below the bag clamps and above the level of product in the filled bag, and extend at least the longitudinally the width of the bag above the level of product in the bag when the subassemblies 378, 379 are in their bag gripping position such as shown in FIG. 10.

Figure 10:
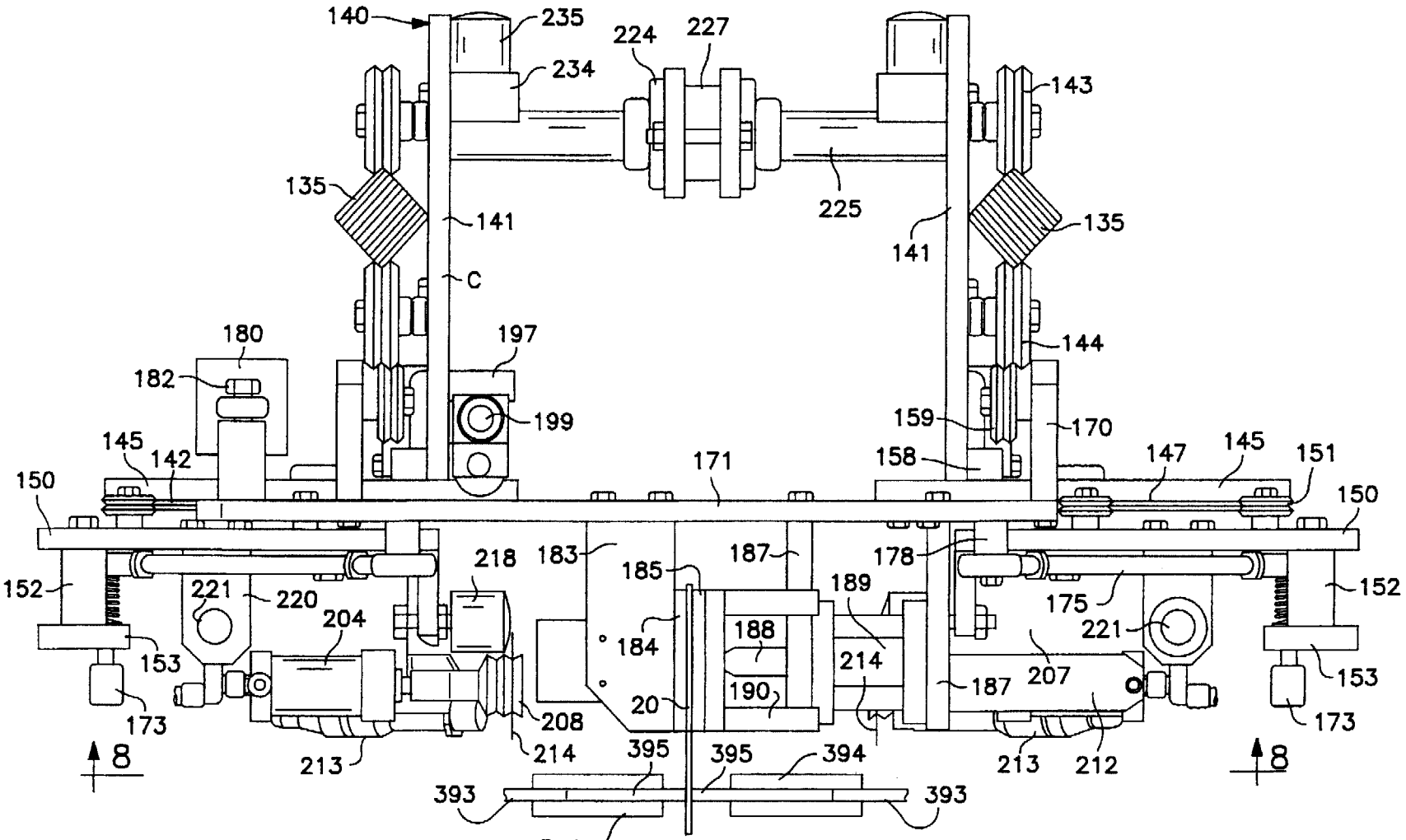
FIG. 10 is a front view of the carriage assembly that is generally taken along the line and in the direction of the arrows 10—10 of FIG. 11 with the transfer assembly grippers gripping the top portion of a filled bag above product in the bag.
Figure 11:
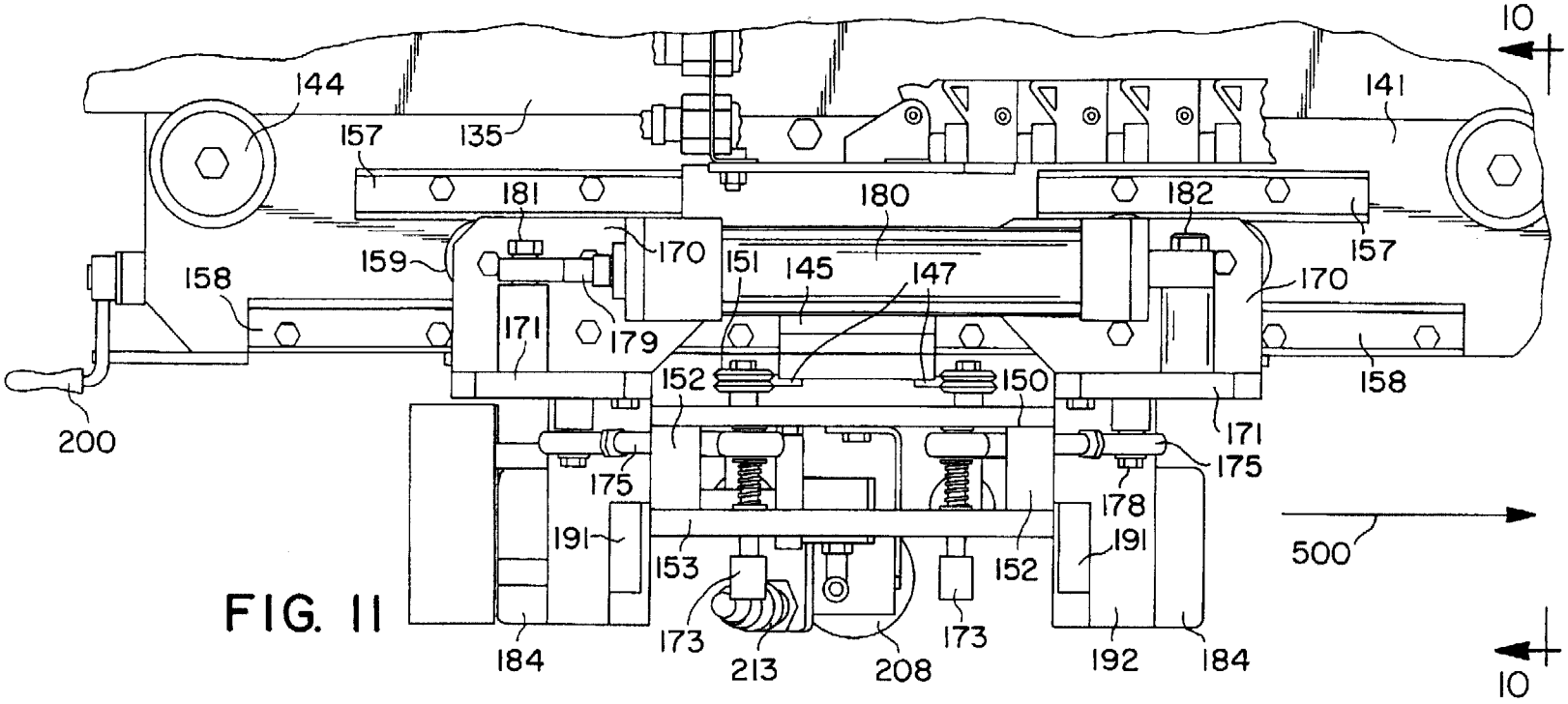
FIG. 11 is a side view of the carriage assembly that is generally taken along the line and in the direction of the arrows 11—11 of FIG. 8B.
Figure 22:
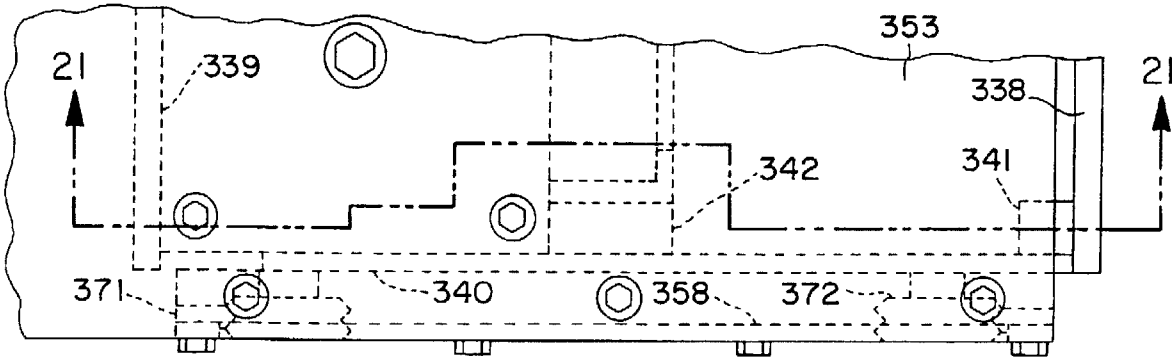
FIG. 22 is an enlarged fragmentary plan view of the shaker saddle assembly.
Figures 12, 16, 23:
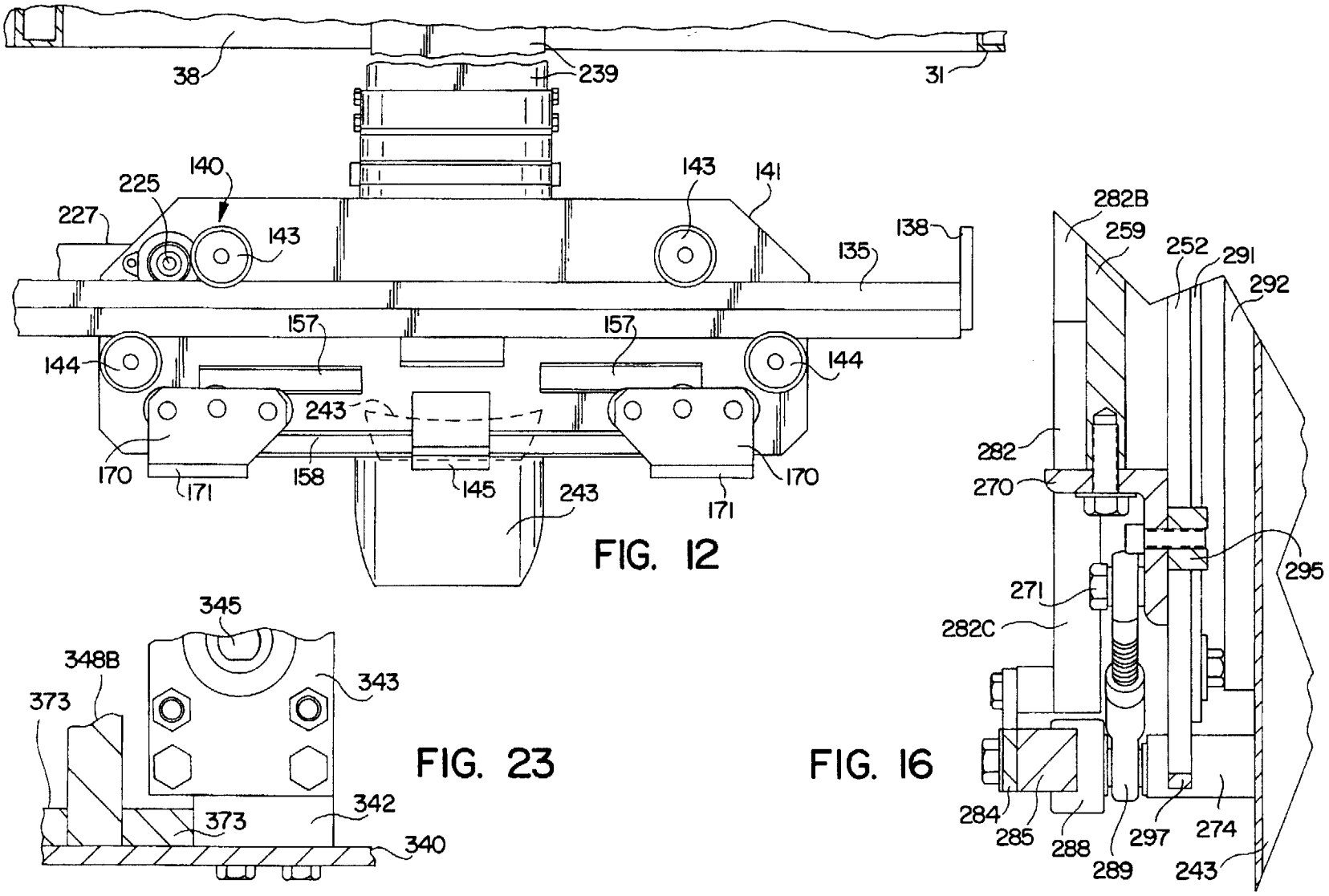
FIG. 12 is a side view of the carriage assembly at the filling station with the spout subassembly in a lowered position in solid lines and its elevated datum position in dotted lines, very many parts of the carriage assembly not being shown.
FIG. 16 is a fragmentary view generally taken along the line and in the direction of the arrows 16—16 of FIG. 13 to more clearly show the linkage mechanism for opening the spout jaws.
FIG. 23 is a fragmentary cross sectional view generally taken along the line and in the direction of the arrows 23—23 of FIG. 20.

For moving the horizontal arms 391 between their spread apart retracted position of FIG. 18 to their bag gripping position of FIG. 10, the cylinder 398 of the transfer gripper piston cylinder combination 398, 399 is pivotally connected at 400 to a bracket 401 that is joined to plate 380. The piston rod 399 is pivotally connected at 402 to the inner arms 387 vertically intermediate pivots 392, 390.

Each of the subassemblies 378, 379 also includes a lower gripper subassembly having a slide rod mount 403 extending between the front and rear set of parallel arms. The rod mount is pivotally connected to each set of parallel arms by the transverse inner and outer pivots 404, 405. The slide rod mount mounts a pair of transverse slide rods 408 in selected transversely adjusted positions relative to the pivots 404, 405. The transverse inner ends of the slide rods mount a clamp pad 407 having a longitudinally extending front portion 407A that is substantially parallel to the corresponding portion of the clamp pad of the other lower gripper subassembly and a rear portion 407B that converges toward the rear portion of the clamp pad of the other lower gripper subassembly. The spacing of the front portions 407B is such that when the piston rods 399 of both of the subassemblies 378, 379 are in their extended positions, the filled bag therebetween is clamped at an elevation between the top level of product in the bag with sufficient force that the bag is moved longitudinally forwardly (arrow 500) over horizontal plate 353 to the discharge conveyor as the clamp pads are moved forwardly. The rear portions 407B rearwardly converge to prevent the filled bag tipping and ensure that the bag is longitudinally moved with the clamp pads. However, when the piston rods 399 are in their retracted position, the rear end portions of pad portions 407B are transversely spaced by a greater distance than the transverse width of a filled bag.

Referring to FIG. 1A, to move the transfer assembly longitudinally between its positions, a bag transfer cylinder 411 of the bag transfer piston cylinder combination 410, 411 is pivotally mounted to the rear upright 22. The piston rod 410 is pivotally connected to a lug 412 which is joined to an intermediate part of one of the longitudinally elongated connecting arm 413, 416. The rear end of the connecting arm are pivotally connected to a transverse mount 414. The mount 414 is attached to the upper ends of the arms 415, the lower ends of the arms 415 being keyed to the transverse shaft 417 which is pivotally mounted to the plates 97. The front end of the connecting arms 413, 416 are pivotally connected 419 to the subassembly plates 380, 381 respectively.

For controlling the movement of the transfer assembly T, a pair of bars 420 are mounted to upright 23 and a vertical channel 421 that is forwardly of upright 23 and joined to channels 28, 30. The bars mount a transfer forward proximity switch 424 and a transfer rear proximity switch 425 in adjusted positions on the bars 420 for sensing when the arms 415 are in their forward and rear pivoted positions respectively and thereby the forward and rear positions of the transfer assembly.

Referring to FIG. 26, the pneumatic circuitry, generally designated 450, includes a source of fluid under pressure 454 and conventional solenoid operated valves V1–V14 that are connected to the various components such as indicated and to function in a manner that will become more apparent. Advantageously, valves V4, V6, V8 and V10 are conventional double solenoid valves while the remaining of the above mentioned valves are single solenoid valves. The solenoid valves are controlled by electric circuitry and components, generally designated 452, and are powered from a power supply 455.

Normally, during initial application of electric power from the power supply 455, the double acting solenoid valves are in fluid connecting positions so that the bag positioner valve V4 is in the chute open position, the bag clamp valve V6 is in the bag clamp release position, the spout valve V10 is in the spout jaws up-closed position and the bag forming valve V8 is in the clamp plates spread apart position.

Figure 15:
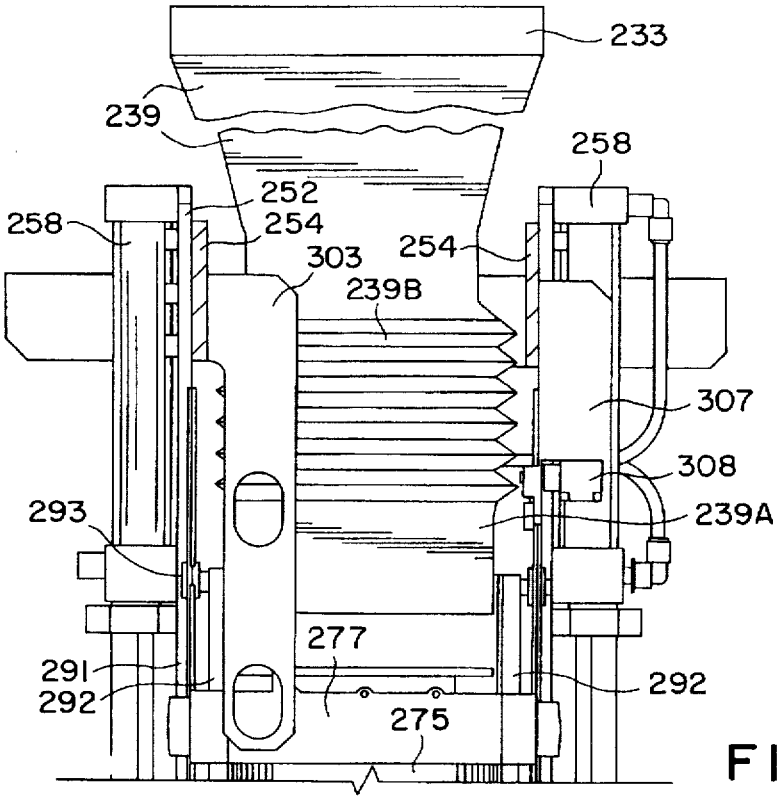
FIG. 15 is a fragmentary view of the hopper spout assembly that is generally taken along the line and in the direction of the arrows 15—15 of FIG. 13.

A conventional scale 233, which is represented by a block in FIG. 15, is suitably mounted in fixed relationship to the main frame, desirably, but not necessarily, by structure that is not attached to the main frame for dumping weighed charges of product into the hopper.

To start the operations, a manually operated power on switch 453 of the electric controls 452 is temporarily held in a closed position to initiate the operation of the electric controls, including the energization of the bag pick up solenoid valve V1 while the bag feed in solenoid valve is deenergized so that the pick up cups 54 are moved downwardly from their elevated, retracted positions and are pivoted about pivot 47 in the direction of arrow 52 to contact the top bag on stack S. At the time the vacuum cups 54 are moving downwardly, the bag pick up and back proximal switch 471 is deactuated which results in the bag feed in solenoid valve V2 being deenergized whereby the mounting plate 45 is pivoted in the direction of arrow 52 and the bag pick up vacuum solenoid V3 being energized to apply pressurized fluid (air) to the vacuum transducers 459 for applying a vacuum to the vacuum cups and to the cylinders 90 for extending piston rods 89 to pivot the rollers 85 in the direction of arrow 93 to be spaced from rollers 75 preparatory to an empty bag being feed between rollers 75, 85. Upon the vacuum cups contacting the bag and being compressed, the bag sensing photo eye 470 senses the top bag 20 in the magazine and sends a signal for the control circuitry to deenergize the pick up valve V1 which results in the discontinuance of the downward movement of the vacuum cups 54 and the vacuum cups moving upwardly.

The bag pick up and back proximity switch 471 in sensing the adjacent guide rod 51 in its retracted position (is actuated), sends a signal for the control circuitry to energize bag feed in valve V2 whereby piston rod 58 is retracted and the pick up cylinder is pivoted in the direction of arrow 52 to move the closed end of the picked up bag to extend between rollers 75, 85 and deenergizes solenoid valve V3. The deenergization of valve V3 results in piston rods 89 retracting so that the arms 74 are resiliently pivoted in the direction opposite arrow 93 to move rollers 85 to clamp the picked up bag between the infeed rollers 75, 85 at the time the application of vacuum to cups 54 is discontinued. With reference thereto, the timing of the discontinuance of pressurized fluid to the transducers 459 is such that there is still enough vacuum in the cups to hold the bag as the rollers 85 are moved to clamp the bag against constantly driven rollers 75. By having the longitudinally spaced roller 85 pivoting to clamp the bag against the rollers 75, there is a substantially decreased likelihood of the bag being skewed relative to the desired path of movement of the bag, or if slightly skewed, not further skewed as the bag is moved by the rollers to the positioner assembly. A double bag feed proximity switch 474 is mounted to bracket 74 to sense the in position of the upper end of adjacent arm 74 after the rollers 75, 85 have clamped a bag therebetween and if the switch has been activated at the time rollers 85 have moved to their clamping position because the upper end of the adjacent arm 84 is in a position corresponding to more than one bag being clamped between the rollers, the controls prevent the vacuum cups 54 being moved to pick up another bag and the carriage assembly being longitudinally moved.

After a preset time delay after the bag feed in solenoid valve V2 has been energized, it is deenergized to pivot plate 45 in the direction of arrow 52 and the pick up solenoid V1 to lower the vacuum cups 54 to pick up another bag.

Figure 3:
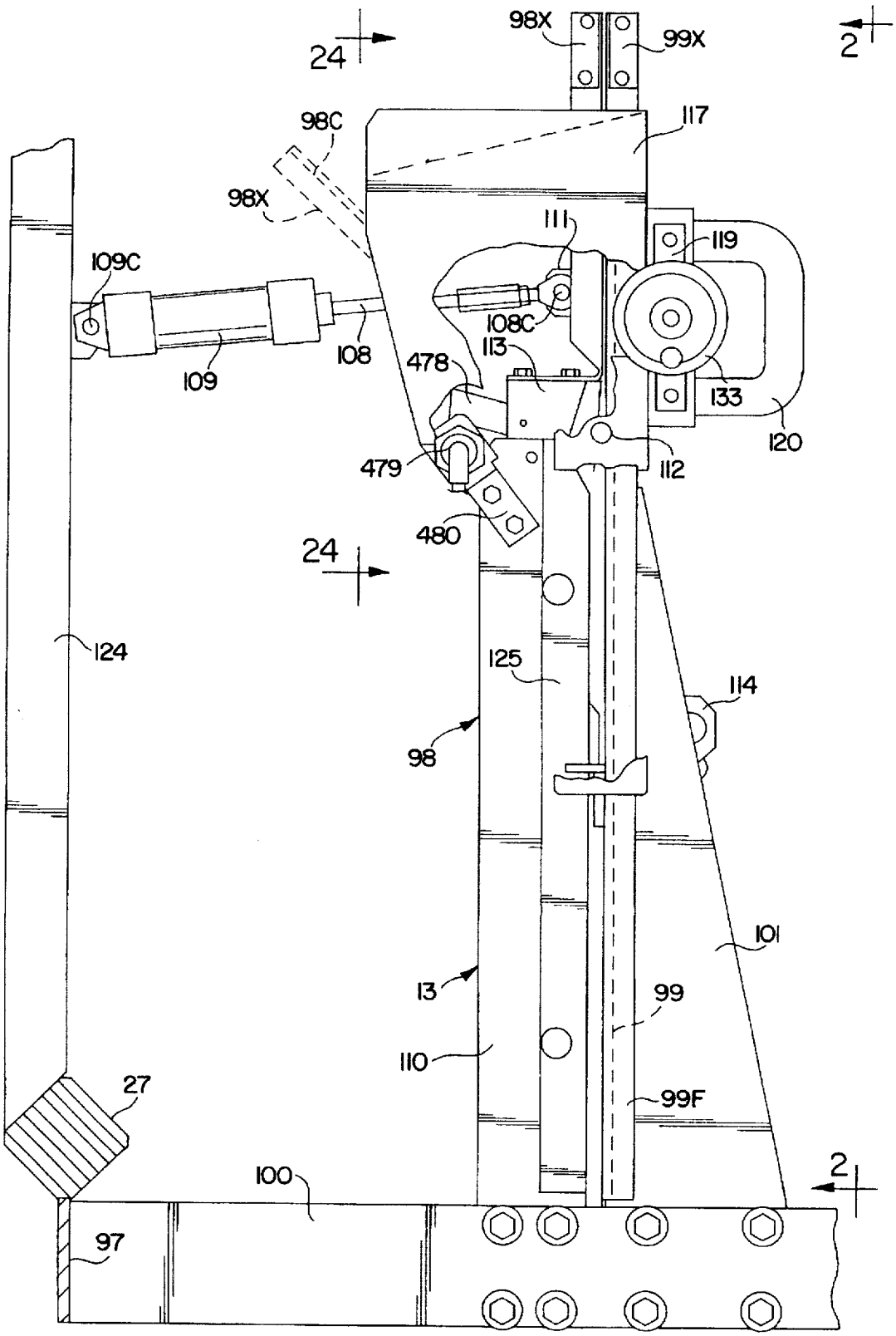
FIG. 3 is a rear end view of the bag positioner assembly with the chute being shown in its closed position in solid lines and in its open position in dotted lines.

Prior to the picked up bag being clamped between the infeed rollers, the bag positioner solenoid valve V4 has been actuated to retract piston rod 108 so that the chute 98C is open (inclined upwardly and transversely away from the upper portion of positioner member 99 such as shown in dotted lines in FIG. 3). As the bag clamped by the infeed rollers is moved thereby, the bag slides over open chute 98C to move downwardly between members 110, 125 and member 99 to engage switch actuator 102 and pivot it in the direction of arrow 475 and move down to have the bag bottom edge 20E abut against the bag stop 477. The pivoting of the actuator 102 actuates the proximity switch 114, this resulting in valve V4 being energized to apply fluid pressure to the bag positioner cylinder 109 for pivoting the chute to its vertical position (closed position) and the bag squaring cylinder 128 for moving the bag guides 115, 117 forwardly to square the bag and longitudinally center the bag in the positioner assembly in a position for being clamped by the carriage assembly in its rear position and then forwardly conveyed by the carriage assembly. Upon the chute pivoting to its closed position, the switch actuator 478 which is mounted to one of the brackets 113 is moved to deactuate proximity switch 479. The switch 479 is mounted to one of the pivot mounts 110 by a bracket 480.

After the spout subassembly having moved to its up position to actuate the spout up proximity switch 304, the deactuation of switch 479 results in the controls energizing the clutch brake release solenoid V5 whereby the clutch brake 230B of the motor is operated so that the drive from drive motor 230 rotates the drive arm 229 to move the connecting arm 227 for moving the carriage assembly rearwardly from its forwardmost (home) position to its rear position. It is noted that the spout up limit switch operated valve 308 is closed to permit fluid communication therethrough from the clutch brake of motor 230 to the source of fluid under pressure as long as the spout jaw subassembly is in its elevated position. Due to the provision of the crank arm 229 extending generally horizontally when the carriage assembly is at each of its forwardmost and rearwardmost positions, the speed of movement of the carriage is decreased when it is adjacent to its rearwardmost position.

After a preset time delay from the energization of the brake release valve, the bag clamp solenoid valve V6 is energized by the controls to move the piston rods 188 and thereby the corner clamps 185 to their clamped position at the time the carriage assembly is in its rearwardmost position to clamp the upper corner portions of a bag that is being retained in its vertical position by the position chute in its vertical position. As the clamps 185 move toward their clamped position, the actuators 195 of the limit switches 191 abut against the adjacent bag top corner 20X and thereby prevent the respective actuator from moving in a hole 185B in the clamp 185 (see FIG. 25). The prevention of both actuators moving into the holes in clamps 185 actuate the no bag no product limit switches whereby the control circuitry permits the scale 233 dumping a weighed charge of product dumping into the hopper. If only one or neither of the switches 191 is actuated, the scale is not actuateable to dump product, nor is the spout subassembly lowerable, as long as at least one of the actuators extends into a hole 185B in the adjacent clamp 185.

The actuation of both of the limit switches 191 results in the control circuitry energizing the bag opening transducer solenoid valve V9 to supply fluid under pressure to the transducers 221 and thereby a vacuum to the vacuum cups 208 and energizing valve V2 for operating piston rod 108 to open the positioner chute 98C and piston rod 119 to move the guides 115, 117 rearwardly. Also the actuation of the limit switches 191 result in the bag opening solenoid valve V7 being energized whereby the piston rods 209 are extended to move the bag opening cups 208 to grippingly engage the longitudinally intermediate, opposite bag top edge portions 20B. After a time delay the control circuitry acts to deenergize valve V7 to retract the vacuum cups 208 to spread the bag top edge portions, for example such as shown in FIG. 7. The gripping engagement of the bag top edge portions results in the accordion type cups 208 collapsing and upon the retraction of piston rods 205, the metal rings 214 move to actuate the bag open proximity switches 213. In the event that either one or both of the cups does not grippingly engage a bag side wall, the respective cup does not collapse and accordingly when the cup is retracted, the metal ring thereon does not actuate the adjacent proximity switch 213. The actuation of both of the bag open switches 213 sends a signal such that the control circuitry operates the scale to dump a weighed charge into the hopper to descend into the movable hopper section and the spout jaws and discontinue the blocking of the spout subassembly being lowered.

The spreading of the bag top edge portions results in the clamp plates 171 moving toward one another, no pressurized fluid being applied to the forming cylinder 180 at this time to prevent the clamp plates moving toward one another. As the clamp plates move toward one another, the links 175 move the bag opening plates 150 transversely away from one another along tracks 147.

As the crank arm continues to rotate, the carriage assembly is moved forwardly with the picked up bag clamped thereto. After a preset time delay from the energization of the brake release valve V5, the control circuitry deenergizes the clutch brake valve to stop the carriage assembly under the spout subassembly in the position to be filled (home position). This acts through the control circuitry to deenergize the clutch brake valve V5 and thereby apply the brake 230B which stops the drive to rotate the crank arm and thereby the longitudinal movement of the carriage assembly with the clamped bag in a position beneath the spout for filling the bag. As the carriage assembly stops adjacent to its forwardmost position of FIG. 1B, it actuates the carriage home (forward) proximity switch 483 (diagrammatically shown in FIGS. 1B and 7) which is mounted by a mount 484 to one of the members 138. In the event the carriage assembly does not stop in the proper position for a bag being filled, the spout subassembly is retained in its elevated position.

It is noted that the saddle top 353 has an edge 353C that is transversely and longitudinally inclined to direct the lower portion of an empty bag to one side in the event that it extends below the elevation to the saddle top as the carriage assembly moves the clamped bag forwardly.

The signal from the actuated home switch 483 acts through the circuitry to energize spout up-down solenoid valve V10 to apply fluid under pressure to the upper ends of the cylinders 258 to lower the spout subassembly and movable hopper section, and to energize the saddle solenoid valve V12 to apply fluid under pressure to the saddle (lift) cylinder 343 for lowering the saddle while the piston rod 345 of the shaker subassembly is in its lowered position. As the spout subassembly moves downwardly from the solid line position of FIG. 7, the limit switch operated valve 308 (FIG. 15) is resiliently operated to block the application of pressurized fluid therethrough to valve V5 and thereby prevents the release of the carriage assembly drive mechanism brake.

As the spout subassembly and the movable hopper section are lowered, the cam rollers 288 roll down along cam roller rail portions 282C to maintain the spout jaws closed as the jaws move downwardly to have their bottom apex portion formed by their side walls converging in a downward direction enter between the spread apart bag top edge portions. At the time the stops 277 abut against bumpers 235 to stop the downward movement of the of the movable hopper section 239A, the spout down proximity switch 305 is actuated at approximately the time the cam rollers roll off the cam roller rail portions 282C lower ends. The continued downward movement of the piston rods 259 act through the links 289 to cause the rods 274, 275 to move transversely away from one another and thereby the jaws to pivot about pivots 279 to their dotted line open position of FIG. 7. As the jaws open, their lower end portions push against the bag top edge portions to move them further apart which act through the bumpers 218 to move the bag opening plates 150 further apart. As the bag opening plates are pushed transversely apart, through links 175, the clamp plates 151 are moved closer together to permit the spout jaws opening the desired amount. As the jaws open, product is discharged into the bag to open the bag beneath the top edge portions to minimize the amount of air flowing into the bag.

The spout down switch 305, when actuated, results in the control circuitry deenergizing the valve V9 to discontinue the application of vacuum to the opening vacuum cups 208 and to energize and deenergize the bag shaker solenoid valve V11 a selected number of times for alternately raising and lowering the saddle top 353 to shake the bag as it is being filled. Upon a sufficient time delay after the actuation of the switch 305 for the bag to be filled, the control circuitry energizes the solenoid valve V10 for elevating the movable hopper section and spout subassembly. The initial application of pressurized fluid to the lower ends of the cylinders 258 results in rollers 288 engaging the cam tracks lower ends and the transversely opposite cam rollers moving closer together to pivot the jaws toward their closed position. As the jaws are closed, the rollers roll over the inclined surfaces of the bumpers 285 to prevent the slapping of the jaws as they close. Thence, the rollers roll along the cam track surfaces 282C to maintain the jaws in a closed position as the spout jaws and movable hopper section 239A are elevated. As the spout subassembly and movable hopper section are elevated, proximity spout down switch 305 is deactuated whereby, after the spout jaws are closed, a signal is sent for the control circuitry operating the scale to dump a weighed charge into the hopper.

Further, at the same time valve 10 is energized to elevate the spout subassembly, the deactuation of switch 305 results in the control circuitry deenergizing the shaker valve V11 to lower the saddle top plate 353 and the deenergization of the valve V12 so that the piston rod 345 raises the piston cylinder combination 349, 350 to elevate the saddle plate 353 to the level for the filled bag being pushed unto the discharge conveyor 44. Also, this deactuation of switch 305 results in the control circuitry energizing the bag former out solenoid V8 and thereby applying fluid pressure to the former cylinder whereby the clamp plates are moved apart and thereby the plates 150 toward one another. As a result, the bag clamps move the bag top corner portions apart to draw the bag top closed after the spout jaws have moved above the bag top edges.

As the jaws are moved adjacent to their elevated position, the limit switch valve 308 is operated to permit pressurized fluid flowing therethrough to the clutch brake mechanism 230 and the spout up proximity switch 305 is actuated to permit the carriage assembly drive being operated to move the carriage assembly rearwardly. During the time the spout subassembly was moving down, the transfer assembly is in its forwardmost position with the gripper members 395 in their spread apart position of FIG. 18. The prior pivotal movement of the transfer arm 415 in the direction opposite arrow 490 to its forward pivoted position (the transfer assembly home position) actuated the transfer forward proximity switch 424 which signals the control circuitry to deenergize the gripper solenoid valve V13 for applying fluid pressure to the cylinders 398 for moving the grippers 395 and the bag clamp pads 407 to their spread apart position to release the closed filled bag on the discharge conveyor to be moved away from the main frame 11.

Further, the movement of the transverse outer arm 387B adjacent to its transverse outer position of FIG. 18 actuates the transfer gripper out proximity switch 491 which is mounted to the adjacent bracket 388. The gripper switch in being actuated provides a signal to the control circuit whereby forward movement of the transfer assembly moving forwardly is prevented until both of the transfer grippers 395 are closed with a bag being held therebetween.

A preset time delay after the actuation of the transfer forward proximity switch 424, the bag transfer solenoid valve V14 is deenergized by the control circuitry whereby fluid under pressure is applied to the transfer cylinder to pivot the transfer arms 415 in the direction of arrow 490 to its rearwardmost position. When the spout up switch 308 is actuated and the transfer back proximity switch 425 is actuated by the adjacent arm 415 pivoting adjacent to its rearwardmost position, the control circuitry operates to energize the transfer grippers solenoid valve V13 for applying pressure to the gripper cylinders 398 for moving the grippers 395 to their closed position for grippingly retaining the closed filled bag in such a condition and clamp the filled bag between the clamp pads and then energizing the clamp bag clamp release solenoid valve V6 for applying fluid pressure to the cylinders 189 for retracting corner clamps 185 to release the bag corners of the filled closed bag clamped between clamps 184, 185. Further, the actuation of the transfer back switch 425 permits the clutch brake release valve V6 being energized.

The releasing of the clamped, filled closed bag results in the limited switches 191 being deactuated whereupon the control circuitry energizes the bag transfer forward solenoid V14 to operate the bag transfer cylinder 411 to move the transfer assembly forwardly to move the gripped, clamped filled bag along the saddle plate 353 from beneath the spout and unto the discharge conveyor. After the bag corner clamps move to their open position, actuation of the transfer back switch results in the clutch brake solenoid valve V5 being energized to result in the crank arm 229 rotating to move the carriage assembly rearwardly to clampingly engage another bag in a vertical condition in the positioner assembly.

Figure 4:
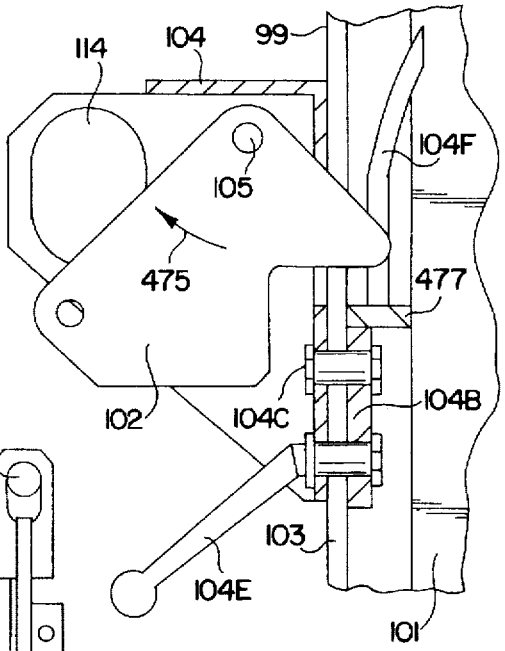
FIG. 4 is an enlarged side view of the bag stop and bag present sensing mechanism.

The carriage assembly bag corner clamps, in clamping the vertical bag in the positioner assembly, move the actuators 195 which provides a signal for the control circuitry energizing valve V4 whereby the piston rod 108 is retracted to move the chute to its open position and the piston rod 129 is extended for moving the pusher member 115 rearwardly while, is the carriage assembly move forwardly, the clamped bag is moved out of the positioner assembly whereby the switch actuator 102 is free to and does pivot to the position of FIG. 4 to deactuate the proximity switch 114.

Upon the deactuation of the proximity switch 114, the control circuitry energizes positioner solenoid valve V4 whereby the piston rod 108 is retracted for opening the positioner chute preparatory to receiving another picked up bag from the feed in rollers 75, 85 and permits the feed in solenoid V2 being energized to feed the second picked up bag to the feed rollers.

During the time the carriage assembly is at its home position and the spout assembly is moved between its positions for filling a bag, the bag pick up assembly has been operated to pick up another bag and the positioner chute moved to its closed position with said another bag between the positioner members 98, 99. Further, during the time the carriage assembly is moved rearwardly from its home position and back to its home position, the transfer assembly moves a filled bag from the filling station to the discharge conveyor.

As may be noted from FIG. 27, the control circuitry can be operated so that product is dumped by the scale to descend to and through the spout jaws only after the spout jaws have started to move to their open position. Further, there are provide manually operated controls (not shown) for selectively controlling the timing of various operations that have been described with reference to the automatic mode of operation above described with the temporary closing of the switch 453.

Even though it has been set forth that the hopper is mounted to the main frame 11, it is to be understood that a hopper may be used that is not mounted to the main frame. Further, even though not mentioned for all the proximity switches, it is to be understood that when a member or subassembly that had been moved to actuate the respective switch is moved away from the switch, the switch is deactuated to discontinue the signal that was previously sent. Additionally, it is to be understood that other appropriate conventional sensors may be utilized in place of proximity switches. Also, a vacuum dust collector assembly (not shown) has dust nozzles mounted to the front and the rear of the spout with inlets adjacent the tops of the shields 301 to draw dust away from the spout jaws during discharge of product into the opened bags.

The machine can be used for filling bags of sizes for holding, for example 25 or 50 pounds of product, and different type of bags, for example paper or plastic bags which are flat tube or gusseted bags, or multi wall, pinch bottom or satchel bottom bags. Also, due to the provision of the apertures 174 in the index plates 153 and apertures 177 in the clamping plates, the positioning of the links 175 may be varied which results in the number of different size spouts assemblies used for filling different size bags is reduced from that required with prior art machines.

With the present invention, one set of piston cylinder combinations serve to provide the operative force for first moving the spout subassembly downwardly and then open the spout jaws together with a mechanical linkage that results in the bag clamp plates moving equal distances toward one another as contrasted to requiring at least one piston cylinder combination for lowering the spout subassembly and at least another cylinder for opening the spout jaws and/or clamping the bag side walls to the spout jaws. For example, during the 8 inches of the downward movement of the piston rods 259 the spout jaws are lowered 5 inches while being maintained in a closed position, and then during the next 3 inches of downward movement, the spout jaws are pivoted to their fully open position. As the jaws pivot to force the bag open, the bag top clamps 185 move inwardly to provide a bag top opening forming a relatively close fit with the spout jaws. Further, only a single piston cylinder combination is utilized for closing the filled bag and has no fluid pressure applied to the cylinder when the bag top clamps move toward one another as the bag is opened. With such an arrangement, the bag top clamps move substantially the same distance at the same rate and number of cylinders utilized are decreased which minimizes timing problems, including those involved in setting up the machine prior using the machine for filling bags.

What is claimed is:

1. In bag filling apparatus having a positioner station, a filling station longitudinally forwardly of the positioner station and a discharge station longitudinally forwardly of the filling station for feeding a flat folded bag having opposite side walls, bag top edge portions including front and rear corner edge portions defining a bag mouth, a bottom edge portion that at least in part defines a bag bottom when the bag is filled, a leading edge and a trailing edge from a bag magazine to a positioner station and thence to a bag filling station, a longitudinally elongated main frame having a front end and a rear end, a bag positioner assembly mounted on the frame at the positioner station for supporting a flat folded bag in a generally vertical condition with the bag top edge portions at a higher elevation than the bottom edge portion, the bag positioner assembly including transversely opposite first and second bag side wall support members for having a flat folded bag fed therebetween, the first support member having at least an upper portion pivotable between an open position inclined upwardly and transversely away from the second support member for having a bag slid thereover and a closed position straightening the flat bag to extend generally vertically between the first and second support members, first means mounted to the main frame for pivoting the support member upper portion about a longitudinal axis between its positions, a bag pick up assembly mounted to the main frame for picking up a flat folded bag from the magazine and feeding the picked up bag toward the positioner assembly and feed means mounted to the frame for receiving the picked up bag from the pick up assembly and transversely feeding the picked up bag to slide over the first support member upper portion when the first support member upper portion is in its open position, said feed means including a pair of transversely spaced first rollers for feedingly engaging one of the side walls of the picked up bag, second means for mounting the first rollers to the main frame and drivingly rotating the first rollers about a longitudinal axis, third means movable between a first position for cooperating with the first rollers to receive the picked up bag from the pick up assembly and to feed the picked up bag to the positioner assembly when the support member upper position is in its open position to reduce the amount of possible skewing of the picked up bag as the picked up bag moves from the pick up assembly to the positioner assembly and a second position of a greater minimum spacing from the axis of rotation of the first rollers than in the first position to facilitate the picked up bag being moved into feeding relationship to the first rollers, fourth means movably mounted to the main frame for mounting the third means to the main frame for movement between its positions and power operated means for moving the fourth means to move the third means to its second position prior to the pick up assembly moving the picked up bag transversely toward the positioner assembly.

2. The apparatus of claim 1 having a discharge station longitudinally forwardly of the filling station in combination with a hopper mounted at the filling station, a carriage assembly, means mounted to the main frame for mounting the carriage assembly for longitudinal movement between a rear position at the positioner station for clampingly engaging the bag corner portions of a bag in the positioner assembly and a forward position at the filling station for having product discharged from the hopper and into the clampingly engaged bag and power operated means for moving the carriage assembly from its rear position to its forward position with the bag clampingly engaged by the carriage assembly, and a saddle shaker assembly mounted at the filling station beneath the hopper for settling product in a bag during the filling of the bag when the carriage assembly is at the filling station, the saddle shaker assembly including an operable saddle subassembly vertically movable for shaking the bag during filling, said saddle subassembly having a bag bottom support member for abutting against the bottom of the bag clampingly engaged by the carriage assembly at the filling station, and a shaker subassembly for mounting the saddle subassembly for vertical movement to a lowered position while the saddle subassembly is operated to shake the bag and an elevated position for having the bag moved thereover to the discharge station, the saddle subassembly including a piston cylinder combination for vertically reciprocating the bag bottom support member and transfer means mounted to the main frame for moving the filled bag along the bag bottom support member from beneath the hopper to the discharge station.

3. The apparatus of claim 1 in combination with a hopper mounted at the filling station, a carriage assembly, means mounted to the main frame for mounting the carriage assembly for longitudinal movement between a rear position at the positioner station for clampingly engaging bag corner portions of a bag in the positioner assembly and a forward position at the filling station for having product discharged from the hopper and into the clampingly engaged bag and power operated means for moving the carriage assembly between its positions, the carriage assembly including a carriage frame, front and rear clamp means for clampingly holding the front and rear bag corner portions of the bag top edge portions to dependingly carry a bag from the positioner assembly to the filling station and supporting the bag as it is being filled, a front clamp mount for mounting the front clamp means, front clamp mounting mechanism for mounting the front clamp mount to the carriage frame for longitudinal movement relative thereto, a rear clamp mount for mounting the rear clamp means, rear clamp mounting mechanism for mounting the rear clamp mount to the carriage frame for longitudinal movement relative thereto, a first vacuum cup for vacuumingly engaging one of the bag top edge portion of one bag side wall intermediate the bag corner portions, a second vacuum cup for vacuumingly engaging the bag top edge portion of the other bag side wall intermediate the bag corner portions, a first vacuum cup mounting member mounting the first vacuum cup for transverse movement between an extended position to vacuumingly engage the adjacent bag top edge portion of a bag clampingly engaged by the front and rear bag clamp means and a retracted position more remote from the second vacuum cup to cooperate with the second vacuum cup to spread the bag top edge portions, a second vacuum cup mounting member mounting the second vacuum cup for transverse movement between an extended position to vacuumingly engage the adjacent bag top edge portion of a bag clampingly engaged by the front and rear bag clamp means and a retracted position more remote from the first vacuum cup to cooperate with the first vacuum cup to spread the bag top edge portions, fifth means for mounting the first and second vacuum cup mounting members to the carriage frame for transverse movement between adjacent first positions with the bag top edge portions extendable therebetween and remote bag filling positions, and mechanical linkage means interconnecting the first and second bag clamp mounting members and the first and second vacuum mounting members to longitudinally move the first and second bag clamp mounting members longitudinally toward one another as the first and second vacuum cup mounting members move away from one another.

4. The apparatus of claim 3 wherein the front and rear clamp mounting mechanism respectively includes longitudinally elongated tracks and means for mounting the clamp mounting members for longitudinal movement along the tracks, and the fifth means includes transversely elongated longitudinal tracks and means for mounting the first and second mounting members for movement along the transversely elongated tracks.

5. The apparatus of claim 1 in combination with a hopper mounted at the feeding station, a carriage assembly, means mounted to the main frame for mounting the carriage assembly for longitudinal movement between a rear position at the positioner station for clampingly engaging bag corner portions of a bag in the positioner assembly when the support member upper portion is in its closed position and a forward position at the feeding station for having product discharged from the hopper and into the clampingly engaged bag and power operated means for moving the carriage assembly between its positions, the carriage assembly including a carriage frame and fifth means mounted to the carriage frame for clampingly engaging the bag in the positioner assembly, permitting the clampingly engaged bag being opened for being filled at the filling station and closing the filled bag and a spout jaw subassembly operable between an open bag filling position and a closed position for blocking the flow of product from the hopper to an open bag, the spout jaw subassembly including first and second spout jaws movable between elevated closed and lowered open positions, the hopper including an upper hopper section mounted in a fixed position relative to the main frame and a movable hopper section vertically movably connected to the fixed hopper section for directing the flow of product from the fixed hopper section to the spout jaws to flow through the spout jaws in their open position, means for mounting the spout jaws to the lower hopper section for vertical movement therewith and between the spout jaws open and closed positions, linkage means movable between elevated and lowered positions and connected to the spout jaws for moving the jaws between lowered and elevated positions, second power operated means mounted to the main frame for moving the linkage means between the linkage means positions and cam means for cooperating with the linkage means to retain the jaws in their closed position as the jaws are moved from their elevated position to adjacent to their lowered position and then to open the jaws as the second power operated means acts to move the linkage means further downwardly.

6. The apparatus of claim 5 wherein the means for mounting the spout jaws includes transversely spaced first and second pivot members pivotally mounting the first and second jaws respectively to the movable hopper section to vertically moved therewith, the linkage means includes a linkage mount attached to the second power operated means for being vertically moved thereby, a first link having one end pivotally connected to the linkage mount and an opposite end pivotally connected to the first jaw at a lower elevation than the first pivot member and a second link having one end pivotally connected to the linkage mount and an opposite end pivotally connected to the second jaw at a lower elevation than the second pivot member.

7. The apparatus of claim 1 wherein the third means includes a pair of transversely spaced second rollers, the fourth means comprises second roller mounting means for mounting the second rollers to the main frame for rotation about an axis parallel to the first rollers rotational axis and moving the second rollers between a first position to cooperate with the first rollers to clampingly retain the picked up bag in engagement with the first rollers to feed the picked bag to slide over the support member upper portion in the support member upper portion inclined position to the positioner assembly and a second position for receiving the picked up bag from the pick up assembly, the axis of rotation of the second rollers in the their second position being more remotely spaced from the first rollers rotational axis than in their first position.

8. The apparatus of claim 7 wherein resilient means is connected to the second roller mounting means for constantly resiliently urging the second roller mounting means to move the second rollers to abuttingly engage the first rollers.

9. The apparatus of claim 8 wherein the pick up assembly includes a pair of vacuum cups for vacuumingly engaging a bag on the magazine and releasing the vacuum engagement with the picked up bag, first piston cylinder means pivotally mounted to the main frame for moving the vacuum cups between an elevated condition and a lowered position to engage a bag on the magazine, second piston cylinder means pivotally mounted to the main frame for pivoting the first piston cylinder means between an in position for feeding a picked up bag between the first and second rollers when the second rollers are in their second position and the vacuum cups are in their elevated position and an out position more remote from the second rollers than when the vacuum cups are in the first piston cylinder means in position, the resilient means acting to move the second roller mounting means to move the second rollers to their first position while the vacuum cups release their vacuum engagement with the vacuum cups in their elevated position and the first piston cylinder means is moving to the in position.

10. The apparatus of claim 9 wherein the second roller mounting means includes a transverse shaft mounting the second rollers for rotation and arm means for mounting the shaft for pivotal movement about a longitudinal axis between the second rollers positions and the fourth means includes third piston cylinder means for pivoting the arm means from the second rollers first position to the second rollers second position after a picked up bag has been fed by the rollers to the positioner assembly.

11. Bag filling apparatus having a filling station and a discharge station for opening a flat folded bag and filling the bag with product wherein the flat folded bag has opposite side walls, bag top edge portions including opposite corner edge portions defining a bag mouth, a bottom edge portion that at least in part defines a bag bottom when the bag is filled, a leading edge and a trailing edge, and filling the opened bag, comprising a longitudinally elongated main frame having a front end and a rear end, a spout subassembly for controlling the flow of product into an opened bag, first means for mounting the spout subassembly to the main frame, a hopper for discharging product into the spout subassembly, an assembly frame, means mounting the assembly frame to the main frame, longitudinally spaced first and second operable clamp means for clampingly holding the opposite corner edge portions of the bag, a first clamp mount for mounting the first clamp means for movement therewith, a second clamp mount for mounting the second clamp means for movement therewith, first clamp mounting mechanism for mounting the first clamp mount to the assembly frame for longitudinal movement relative thereto, second clamp mounting mechanism for mounting the second clamp mount to the assembly frame for longitudinal movement relative thereto, transversely opposed first and second vacuum cups for vacuumingly engaging the adjacent side wall bag top edge portion longitudinally intermediate the bag corner edge portions, first and second vacuum cup mounting means for mounting and moving the vacuum cups toward one another from a retracted position to an extended position for vacuumingly engaging the adjacent bag top edge portion and spreading the bag top edge portions while being retracted in vacuum engagement with the bag top edge portions, third and fourth mounting mechanisms mounting the first and second vacuum cup mounting means for transverse movement toward and away from one another, and mechanical linkage means interconnecting the first and second clamp mounts and the first and second vacuum mounting means to longitudinally move the first and second bag clamp mounts longitudinally toward one another as the first and second vacuum cup mounting means move away from one another.

12. The apparatus of claim 11 wherein the spout subassembly includes first and second jaws movable between a closed position preventing the discharge of product from the hopper to the bag and an open position, said jaws having side walls that transversely converge in a downward direction to provide a bottom apex in a closed position, jaw mounting means for mounting the jaws for movement between their positions and jaw operating means mounted to spout subassembly mounting means and connected to the jaws for moving the jaws in a closed position from an elevated position relative to the main frame to a lowered position in a closed position to enter between the spread apart bag top edge portions at an elevation to extend between the first and second vacuum mounting means and then opening the jaws to act through bag top edge portions to move the first and second vacuum mounting means away from one another.

13. The apparatus of claim 12 wherein a saddle shaker assembly is provided for settling product in a bag as it is filled and saddle shaker mounting means mounts the saddle shaker assembly beneath the spout subassembly, the saddle shaker assembly includes an operable saddle subassembly that is vertically movable in abutting relationship to the bottom of the bag that is being filled and a shaker subassembly for mounting and moving the saddle subassembly between a lowered position during which time the saddle assembly shakes the bag and an elevated position for the filled bag with settled product being moved forwardly from beneath the spout subassembly to the discharge station, the saddle subassembly includes a horizontally elongated bag bottom support member for abutting against the bag bottom and extending beneath the spout subassembly and adjacent to the discharge station and first power operable means connected to the bag bottom support member for vertically reciprocating the bag bottom support member to shake product in the bag beneath the spout subassembly and the shaker subassembly includes a shaker frame mounted by the saddle shaker assembly mounting means and operable second power operated means mounted by the shaker frame for vertically moving the first power operated means between a lowered position and an elevated position for having the filled bag moved over the bag bottom support member to the discharge station, control means for operating the second power means to move the first power operated means to its lowered position prior to the bag beneath the spout subassembly being filled and to its elevated position after the product in the bag is settled and a transfer assembly mounted to the main frame for moving the filled bag to the discharge station when the first power operated means has been moved by second power operated means to its elevated position.

14. The apparatus of claim 13 wherein each of the power operable means includes a piston cylinder combination, and the means for mounting the saddle shaker assembly comprises means mounted to the main frame for selectively varying the elevation of the shaker frame.

15. The apparatus of claim 13 having a positioner station located longitudinally rearwardly of the hopper wherein a positioner assembly is mounted to the main frame at the positioner station for supporting a flat folded bag in a vertical position to have its top edge portions extending above the positioner assembly, the assembly frame comprises a carriage frame, the means for mounting the assembly frame comprises longitudinal rail means mounted to the main frame for mounting the carriage frame for movement between a rear position above the positioner assembly for the clamp means to clampingly engage the bag top corner portions of a bag in the positioner assembly and a forward position beneath the spout subassembly for being filled and the control means includes means for operating the clamp means to clampingly engage the bag in the positioner assembly and to release the clampingly engaged bag after the bag is filled, and the transfer means to move the filled bag forwardly after the clamp means has released the filled bag.

16. The apparatus of claim 12 wherein the jaw mounting means comprises first pivot means for mounting the jaws for pivotal movement between their open and closed position, the jaw operating means includes a first link and a second link, each link having a first end and a second end, second pivot means for connecting the first link first end to the first jaw for moving the first jaw for movement with the first link, third pivot means for connecting the second link first end to the second jaw for moving the second jaw for movement with the second link, bracket means for pivotally mounting the links second ends at a lower elevation than the first pivot means, power operated means for vertically moving the bracket means between raised and lowered positions for moving the links to move the second and third pivot means for moving the jaws between their positions and cam means for abutting against the second and third pivot means for retaining the jaws in their closed position during the major portion of the downward movement of the bracket means and then allowing the jaws moving toward their open position and retaining the jaws in a closed position after the jaws are closed in their lowered position and the bracket means is moved further upwardly.

17. The apparatus of claim 16 wherein the hopper includes a fixed upper portion and a vertically movable lower section for having product flow therethrough from the hopper upper portion to the spout subassembly, said first pivot means being joined to the lower hopper section to move therewith to move the hopper lower section vertically with the vertical movement of the jaws, the first mounting means including a vertical elongated mounting member joined to the main frame, said jaw operating means being mounted to the mounting member, said second and third pivot means includes a cam roller, said cam means including vertically elongated, transversely spaced roller rails having transversely spaced portions against which the cam rollers abut to retain the jaws in a closed position as the jaws are initially moved downwardly from their raised position and to close the jaws as the jaws are initially moved upwardly from their open lowered position.

18. The apparatus of claim 16 wherein each of the first and second clamp mounts respectively include transversely elongated front and rear clamp plates having transverse opposite end portions, the third and fourth mounting mechanisms respectively include longitudinally elongated first and second vacuum cup mounting plates having longitudinal front and rear end portions and the linkage means includes a third link having one end pivotally connected to front end of the first vacuum cup mounting plate and an opposite end pivotally connected to one end portion of the front clamp plate and a fourth link having one end pivotally connected to the front end portion of the second vacuum cup mounting plate and an opposite end pivotally connected to the other end portion of the front clamp plate.

19. The apparatus of claim 18 wherein the third and fourth mounting mechanisms respectively include first and second transversely elongated tracks in transverse spaced relationship to one another, first wheels means mounted to the first vacuum cup mounting plate to roll along the first tracks and second wheels means mounted to the second vacuum cup mounting plate to roll along the second tracks and the first and second mounting mechanisms included third and fourth longitudinally elongated tracks in longitudinal spaced relationship, third wheel means mounted to the first clamp plate to roll along the third tracks and fourth wheel means mounted to the second clamp plate to roll along the fourth tracks and a piston cylinder combination for moving the clamp plates longitudinally away from one another when a filled bag is clampingly engaged by the carriage assembly to close the filled bag and allow the clamp plates moving toward one another as the first and second vacuum mounting means move apart when the jaws move to their open position.

20. Bag filling apparatus having a filling station for opening and filling a flat folded bag with product wherein the flat folded bag has opposite side walls and bag top edge portions including opposite corner edge portions defining a bag mouth, comprising a longitudinally elongated main frame having a front end and a rear end, a hopper, a spout subassembly for controlling the flow of product from the hopper and into an opened bag, first means for mounting the spout subassembly to the main frame, an assembly frame, means for mounting the assembly frame to the main frame, longitudinally spaced first and second operable clamp means mounted to the assembly frame for clampingly holding the adjacent corner portions of a flat folded bag while the flat folded bag is being opened and filled and closing the filled bag, opening means mounted to the assembly frame for spreading the bag top edge portions while the bag is being clampingly held by the clamp means, the spout subassembly including first and second jaws movable between a closed position blocking the discharge of product from the spout subassembly and an open position, said jaws having side walls that transversely converge in a downward direction to provide a bottom apex in a closed position for blocking the discharge of the product from the hopper to the bag, said hopper having an upper section mounted at a fixed vertical elevation and a lower hopper vertically movable relative to the hopper upper section for having product flow therethrough from the hopper upper section, first pivot means for mounting the jaws to the lower hopper section for pivotal movement between the jaw closed and open positions and vertical movement with the lower hopper section, a first link and a second link each having a first end and a second end, second pivot means for connecting the first link first end to the first jaw for moving the first jaw with movement of the first link, third pivot means transversely spaced from the second pivot means for connecting the second link first end to the second jaw for moving the second jaw with movement of the second link, bracket means for pivotally mounting the links second ends at a lower elevation than the first pivot means and in downward diverging relationship in both the jaw closed and open positions, a piston cylinder combination connected to the main frame and connected to the bracket means for vertically moving the bracket means between an elevated positions that the jaws are in a closed position and vertically spaced from the bag top edge portions of the bag being clampingly held by the clamp means and means for cooperating with the second and third pivot means to retain the jaws in a closed position as the bracket means is moving downwardly from its elevated position until the bottom apex enters between the spread apart bag top edge portion and then one of permitting the jaws to move and moving the jaws to their open position.

21. The apparatus of claim 20 wherein the means cooperating with the second and third pivot means comprises rails having vertical parallel edge portions and cam rollers mounted to the second and the third pivot means to roll along the rail vertical edge portions to maintain the jaws in their closed position and after rolling downwardly off the parallel edge portions, permitting the jaws to move to their open position.

22. The apparatus of claim 21 wherein the rail vertical edge portions are of lengths that during the major part of the downward movement of the bracket means from its elevated position and the length of the piston cylinder stroke coact to maintain the jaws in their closed position and after cam rollers move off said vertical edge portions, the continued downward movement of the bracket means acts through the links and the second and third means to force the jaws open.

23. Bag filling apparatus having a filling station for opening and filling a flat folded bag with product wherein the flat folded bag has opposite side walls, bag top edge portions including opposite corner edge portions defining a bag mouth and a bag bottom edge portion that at least in part forms a bag bottom when the bag is filled, comprising, a longitudinally elongated main frame having a front end and a rear end, a hopper spout assembly mounted to the main frame at the filling station for discharging product into a bag having spread apart bag top edge portions, first means mounted to the main frame to spread the bag top edge portions of a flat folded bag and clampingly holding the bag beneath the hopper spout assembly as the bag is being filled, closing the bag top edge portions after the bag is filled and releasing the clampingly holding of the bag after the bag is filled and closed, a saddle shaker assembly mounted at the filling station beneath the hopper spout assembly for settling product in the bag is being filled and the bag is being clampingly held, said saddle shaker assembly including an operable saddle subassembly for vertically shaking the bag during filling, said saddle subassembly having a bag bottom support member for abutting against the bottom of the bag clampingly held by the first means and means for vertically reciprocating the bag bottom support member between a first elevated position relative to the shaker subassembly and a lowered elevation relative to the shaker subassembly to shake the bag, and a shaker subassembly for mounting the saddle subassembly for vertical movement and moving the saddle subassembly to a lowered position while the saddle subassembly is operated to shake the bag and an elevated position for having the bag moved thereover from beneath the hopper spout assembly after the bag has been filled, and means for mounting the shaker assembly to the main frame.

24. The apparatus of claim 23 wherein the means for reciprocating the support member comprises a first piston cylinder combination, the shaker subassembly includes a shaker frame, bracket means for mounting the first piston cylinder combination for vertical movement therewith, and a second piston cylinder combination mounted to the shaker frame for vertically moving the bracket means between the saddle subassembly lowered position and the saddle subassembly elevated position.

25. The apparatus of claim 24 having a discharge station longitudinally forwardly of the filling station wherein a discharge conveyor is provided at the discharge station and transfer means is mounted to the main frame for longitudinally moving the filled bag along the bag bottom support member from beneath the hopper to the discharge station when the saddle subassembly is in its lowered position and the filled bag has been closed and no longer is clampingly held.

26. The apparatus of claim 25 having a positioner station relative to the main frame longitudinally rearwardly of the filling station for having a bag fed thereto from a stack of flat folded bags on a bag magazine transversely aligned with the positioner assembly, in combination with a positioner assembly mounted to the main frame at the positioner station for receiving a flat folded picked up bag and supporting the flat folded bag in an upright condition with the bag top edge portions extending thereabove, said positioner assembly including a first support member, a second support member having an upper portion movable about a longitudinal axis between an open position inclined upwardly and away from the first support member to receive a flat folded bag to slide thereover and a closed position to cooperate with the first support member for supporting the flat bag in a substantially vertical condition and first operable means mounted to the main frame for moving the upper support portion between its positions, bag feed means for receiving a picked up flat folded bag and feeding the picked up bag to slide over the support member upper portion in its inclined position, said bag feed means including driven first roller means mounted to the main frame to rotate about a longitudinal axis for supportingly moving the picked up bag toward the positioner assembly, second roller means movable relative to the first roller means between a first position to cooperate with first roller means for clampingly retaining a picked up bag in clampingly abutting relationship to the first roller means for being fed therebetween to slide over the support member upper portion in it open position and a second position spaced from the first roller means, including being more remotely spaced from the first roller means longitudinal axis than in the second roller means first position and second power operated means for moving second roller means to the second roller means second position, vacuum means for vacuumingly engaging a flat folded bag on the magazine to pick up a flat folded bag on the magazine and discontinue the vacuum to release the picked up bag for being fed to the positioner assembly by the first and second roller means, and third power operated means mounted to the main frame for moving the vacuum means downwardly to vacuumingly engage a bag on the magazine, then elevate the vacuum means to pick up a flat folded bag from the magazine, thereafter move the vacuum means to move the picked up bag to extend between the first and second roller means when the second roller means is in its second position and thence allowing the second roller means moving to its first position as the vacuum to the vacuum means is discontinued.

27. The apparatus of claim 26 wherein the assembly frame includes a carriage frame, means for mounting the carriage frame for longitudinal movement between a home position for positioning the first means to clampingly hold a bag beneath the hopper spout assembly to be filled and a rear position to clamping engage the bag top corner portions in the positioner assembly for removing the bag from the positioner assembly and move the clampingly engaged bag forwardly to the carriage frame home position, and the hopper spout assembly includes a spout subassembly for directing product into clampingly held bag when the carriage frame is at its home position, an upper hopper section mounted in a fixed position relative to the main frame, and a vertically movable lower hopper section mounted for vertical movement to direct product flowing through the hopper upper section to the spout subassembly and the spout subassembly includes first and second jaws movable between elevated closed and lowered open positions, means for mounting the spout jaws to the lower hopper section to move vertical therewith and to move between open and closed positions, a linkage mount vertically movable between an elevated position and a lowered position, linkage means mounted to the linkage mount to move therewith and relative thereto for moving the jaws downwardly to their lowered position and as the linkage mount is moved adjacent to its lower position, the jaws to their open position, means for cooperating with the linkage means to retain the jaws in their closed position until the linkage means is moved adjacent to its lowered position and then permit the jaws being moved to their open position as the linkage mount is moved to its lowered position, fourth power operated means connected to the linkage mount to move the linkage mount between its positions and means for mounting the means for cooperating with the linkage means and the fourth power operated means to the main frame.

28. The apparatus of claim 26 having a discharge station longitudinally forwardly of the filling station wherein a discharge conveyor is provided at the discharge station and transfer means is mounted to the main frame for longitudinally moving the filled bag along the bag bottom support member from beneath the hopper to the discharge station, the transfer means includes transversely opposed gripper members for retaining the bag top edge portions of a filled bag in a closed position as the filled bag is moved forwardly over the bag bottom support member, transversely opposed clamp pads for engaging the side walls of a filled bag to move the filled bag forwardly along the bag bottom support member, first and second transversely opposite transfer assembly frames, means for mounting the transfer assembly frames for movement between a position beneath the carriage assembly in its home position and a forward position at the discharge station, fifth power operated means mounted to the main frame for moving the transfer assembly frames for movement between their positions, clamp pad and gripper member mounting means for transversely moving the clamp pads and gripper members relative to the respective transfer assembly frame between first positions to engage the bag side walls and the bag top edge portions and second positions that the clamp pads and gripper members are more remotely spaced than in their first positions and sixth power operated means for moving the clamp pad and gripper member mounting means between their position; and control means are provided for controlling the operation of the fourth power means to maintain the linkage mount in its elevated position until both bag corner portion are clamping held by the first means and is beneath the spout subassembly for being filled, the third power operated means to retain the carriage frame in its home position while the bag clampingly held by the first means is being filled and the fourth power means moves the linkage mount upwardly adjacent to its elevated position and the sixth means to move the clamp pads and gripper members to their first position after operating the first means to close the filled bag subsequent to the fourth means moving the linkage mount from its lowered position to adjacent to its elevated position and thence the fifth means to move the transfer frames forwardly from their rear positions and the carriage frame to its rear position.

* * * * *